US008642238B2

(12) United States Patent
Nozaki et al.

(10) Patent No.: US 8,642,238 B2
(45) Date of Patent: Feb. 4, 2014

(54) TONER, DEVELOPER AND METHOD FOR PRODUCING TONER

(75) Inventors: Tsuyoshi Nozaki, Osaka (JP); Tomoharu Miki, Osaka (JP); Tomohiro Fukao, Osaka (JP); Kazuoki Fuwa, Hyogo (JP); Yoshimichi Ishikawa, Hyogo (JP); Yoshihiro Mikuriya, Hyogo (JP); Takuya Kadota, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/557,568

(22) Filed: Jul. 25, 2012

(65) Prior Publication Data

US 2013/0029260 A1 Jan. 31, 2013

(51) Int. Cl.
*G03G 9/087* (2006.01)

(52) U.S. Cl.
USPC ..... 430/110.1; 430/109.4; 430/109.3

(58) Field of Classification Search
USPC ..... 430/110.1
See application file for complete search history.

(56) References Cited

U.S. PATENT DOCUMENTS

| | | | |
|---|---|---|---|
| 2006/0204882 A1 | 9/2006 | Nozaki et al. | |
| 2007/0218393 A1 | 9/2007 | Nozaki et al. | |
| 2009/0286176 A1 | 11/2009 | Ohmura et al. | |
| 2010/0055603 A1 | 3/2010 | Nozaki et al. | |
| 2010/0239974 A1 | 9/2010 | Nozaki et al. | |
| 2011/0020030 A1* | 1/2011 | Mera et al. | 399/111 |
| 2011/0164901 A1 | 7/2011 | Yamamoto et al. | |

FOREIGN PATENT DOCUMENTS

| | | |
|---|---|---|
| JP | 2005-084183 | 3/2005 |
| JP | 2006-195260 | 7/2006 |
| JP | 2007-003840 | 1/2007 |
| JP | 4033096 | 11/2007 |
| JP | 2008-089670 | 4/2008 |
| JP | 2008-180938 | 8/2008 |
| JP | 2009-301026 | 12/2009 |
| JP | 2011-123483 | 6/2011 |
| WO | 2011/052794 A1 | 5/2011 |

* cited by examiner

*Primary Examiner* — Peter Vajda
(74) *Attorney, Agent, or Firm* — Oblon, Spivak, McClelland, Maier & Neustadt, L.L.P.

(57) ABSTRACT

A toner including: a core particle; and fine resin particles, the core particle containing at least a binder resin, a releasing agent and a colorant, wherein the toner is in shape of particles, and each toner particle has a sea-island structure having the core particle and island portions, which are convex portions formed from the fine resin particles on surface of the core particle, wherein the binder resin contains first and second resins, and the fine resin particles are made of third resin, wherein the first resin is crystalline resin, and the second and third resins are non-crystalline resin, wherein the second resin has glass transition temperature (Tg2) and the crystalline resin has melting point (Tc1) where Tg2 is higher than Tc1, and wherein the third resin has glass transition temperature (Tg3) and the toner has glass transition temperature (Tgt) wherein Tg3 is higher than Tgt.

19 Claims, 4 Drawing Sheets

TONER, DEVELOPER AND METHOD FOR PRODUCING TONER

BACKGROUND OF THE INVENTION

1. Field of the Invention

The present invention relates to a toner, a developer, and a method for producing a toner.

2. Description of the Related Art

Hitherto, there have been disclosed electrostatic image developing toner particles each containing: a colored resin particle (core) produced by the emulsification dispersion method; and a coating layer made of resin particles produced by the emulsification polymerization method using a surfactant or by the emulsification dispersion method using a surfactant, wherein the core is made of polyester resin and the coating layer is made of vinyl resin (see, for example, Japanese Patent Application Laid-Open No. 2005-084183).

A contact heating fixing system such as a heating roller fixing system is widely employed as the fixing system for toner. In the contact heating fixing system described above, a low heating temperature means saving energy. Therefore, a resin in a toner preferably has a low melting point. However, a mechanical stress or a thermal stress is applied to a toner in the electrophotography process, which imposes limitation on thermal characteristics of the toner such as glass transition temperature to avoid blocking, or on molecular weight of the toner to prevent cracking. The resin contained in the toner is preferable to satisfy these characteristics. These two are in a trade-off relationship and balancing these two is preferable. To strike this balance, a core/shell type toner is manufactured and known. Such a toner contains a resin favorable in terms of heat fixing in the core and a resin favorable in terms of blocking in the shell that covers the core. In addition, as a material for such a resin, polyester is well known because of its advantages for toughness, heat resistance and fixability. For example, there is known a technology in which a core particle is manufactured by agglomeration and/or curing salting of a liquid dispersion of polyester resin particles using an agglomeration salt and a liquid dispersion of polyester resin particles is added to form a shell layer by agglomeration/curing salting using an agglomeration salt followed by adhesion of the core particle and the shell layer (see Japanese Patent (JP-B) No. 4033096). Furthermore, there is known a method in which both a core and a shell layer are formed by dissolving a polyester resin in an organic solvent and preparing resin particles by a phase transfer emulsification followed by addition of an electrolyte for agglomeration (see JP-A No. 2008-089670). Moreover, there is known a toner containing a non-crystalline resin as a main ingredient and a crystalline resin mixed with the non-crystalline resin, in order to improve fixability at low temperatures (see JP-A No. 2008-180938).

However, there has not been obtained a toner whose shell layer sufficiently exhibits its intrinsic function without impeding fixability of the core. Especially for one-component developing process, there has not been obtained a toner with a core-shell structure which is resistant to severe conditions in a developing device and also exhibits satisfactory fixability.

SUMMARY OF THE INVENTION

The present invention aims to provide a toner having a core-shell structure which toner has a shell layer that sufficiently exhibits its intrinsic function without impeding fixability of the core to thereby obtain both good fixability and good heat resistance, which toner is excellent in uniform chargeability and environmental stability, which toner has a core with thermal properties that can be resistant to severe conditions in a developing device especially for one-component developing process, and which toner has excellent fixability.

The present inventors conducted extensive studies to solve the above existing problems and as a result have accomplished the present invention. Means for solving the above problems are as follows.

<1> A toner including:

a core particle; and fine resin particles, the core particle containing at least a binder resin, a releasing agent and a colorant, wherein the toner is in shape of particles, and each toner particle has a sea-island structure having the core particle and island portions, which are convex portions formed from the fine resin particles on a surface of the core particle, wherein the binder resin contains at least a first resin and a second resin, and the fine resin particles are each made of a third resin, wherein the first resin is a crystalline resin, and the second resin and the third resin are each a non-crystalline resin, wherein the second resin has a glass transition temperature (Tg2) and the crystalline resin has a melting point (Tc1) where the glass transition temperature (Tg2) is higher than the melting point (Tc1), and wherein the third resin has a glass transition temperature (Tg3) and the toner has a glass transition temperature (Tgt) where the glass transition temperature (Tg3) is higher than the glass transition temperature (Tgt).

<2> The toner according to <1>, wherein the melting point (Tc1) is higher than the glass transition temperature (Tgt).

<3> The toner according to <1> or <2>, wherein a difference $\Delta T$ between the maximum value and the minimum value among the Tg2, the Tg3, the Tgt and the Tc1 is greater than 0° C. but smaller than 10° C.

<4> The toner according to any one of <1> to <3>, wherein the core particle is made mainly of the second resin where at least the first resin, the releasing agent and the colorant are dispersed.

<5> The toner according to any one of <1> to <4>, wherein the first resin, the second resin and the third resin are incompatible one another.

<6> The toner according to any one of <1> to <5>, wherein the first resin is a crystalline polyester resin, the second resin is a non-crystalline polyester resin, and the third resin is a vinyl resin.

<7> The toner according to any one of <1> to <6>, wherein the third resin is a vinyl resin obtained by polymerizing a monomer mixture containing 80% by mass to 99% by mass of an aromatic compound monomer having a vinyl polymerizable functional group and 1% by mass to 20% by mass of an acryl monomer.

<8> The toner according to <7>, wherein the monomer mixture contains 80% by mass to 99% by mass of styrene and 1% by mass to 20% by mass of butyl acrylate, and a total amount of the styrene and the butyl acrylate contained in the monomer mixture is 90% by mass to 100% by mass.

<9> The toner according to any one of <1> to <8>, wherein the binder resin further contains a modified polyester resin having at least one of a urethan group and a urea group.

<10> The toner according to <9>, wherein the modified polyester resin is chain-elongated, or crosslinked, or both chain-elongated and crosslinked by reacting an amine with a polyester resin having an isocyanate group at an end thereof.

<11> The toner according to any one of <1> to <10>, wherein the fine resin particles have a weight average particle diameter of 50 nm to 300 nm, and a total surface area of the island portions is 50% to 80% of a total surface area of each toner particle.

<12> The toner according to any one of <1> to <11>, wherein the convex portions have an average height of 0.03 μm to 0.1 μm.

<13> The toner according to any one of <1> to <12>, wherein the releasing agent is at least one selected from the group consisting of paraffin wax, Fischer-Tropsch wax and polyethylene wax.

<14> A developer including:

the toner according to any one of <1> to <13>.

<15> A method for producing a toner, the method including:

dissolving or dispersing in an organic solvent at least a first resin, a second resin, a releasing agent and a colorant, to thereby prepare a solution or dispersion liquid, where the first resin is a crystalline resin and the second resin is a non-crystalline resin;

suspending the solution or dispersion liquid in an aqueous medium, to thereby prepare a dispersion liquid containing core particles dispersed therein, where each core particle contains at least the first resin, the second resin, the releasing agent and the colorant;

adding a fine resin particle dispersion liquid, which contains fine resin particles formed of a third resin dispersed therein, to the dispersion liquid containing the core particles dispersed therein, to thereby form convex portions formed of the fine resin particles on a surface of each of the core particles, where the third resin is a non-crystalline resin; and removing the organic solvent, wherein the second resin has a glass transition temperature (Tg2) and the crystalline resin has a melting point (Tc1) where the glass transition temperature (Tg2) is higher than the melting point (Tc1), and the third resin has a glass transition temperature (Tg3) and the toner has a glass transition temperature (Tgt) where the glass transition temperature (Tg3) is higher than the glass transition temperature (Tgt).

<16> The method according to <15>, wherein the aqueous medium includes a surfactant.

<17> The method according to <15> or <16>, wherein the fine resin particle dispersion liquid contains no organic solvent and contains the fine resin particles in the form of solids dispersed therein.

<18> The method according to any one of <15> to <17>, wherein the removing the organic solvent is completely removing the organic solvent after the convex portions have been formed.

<19> The method according to any one of <15> to <18>, wherein in the adding the fine resin particle dispersion liquid, an amount of the organic solvent contained in the dispersion liquid containing the core particles dispersed therein is 10% by mass to 70% by mass relative to an amount of solid matter contained in the dispersion liquid containing the core particles dispersed therein.

The present invention can provide a toner having a core-shell structure which toner has a shell layer that sufficiently exhibits its intrinsic function without impeding fixability of the core to thereby obtain both good fixability and good heat resistance, which toner is excellent in uniform chargeability and environmental stability, which toner has a core with thermal properties that can be resistant to severe conditions in a developing device especially for one-component developing process, and which toner has excellent fixability.

DETAILED DESCRIPTION OF THE INVENTION (Toner)

—Sea-Island Structure—

Figure 1:
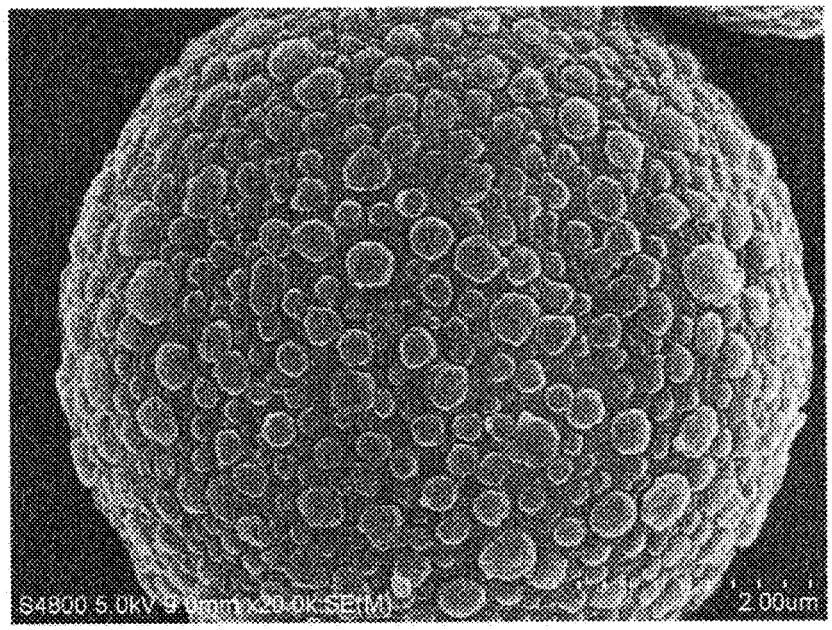
FIG. 1 is a SEM image of the appearance of a toner particle of the present invention.

A toner of the present embodiment is a toner including: a binder resin; a releasing agent; a colorant; and fine resin particles, wherein the toner is in shape of particles, and each toner particle has a sea-island structure having a main portion and island portions, where the main portion contains at least the binder resin, the releasing agent and the colorant, and the island portions are convex portions formed from the fine resin particles on a surface of the main portion.

The binder resin contains at least a first resin which is a crystalline resin and a second resin which is a non-crystalline resin, and the fine resin particles are each formed of a third resin which is a non-crystalline resin. The first resin and the second resin are incompatible with each other and the main portion itself forms a sea-island state. The convex portions are formed on such main portion's surface as the island portions. In this case, the main portion exists as a sea portion.

The second resin has a glass transition temperature (Tg2) and the crystalline resin has a melting point (Tc1) where the Tg2 is higher than the Tc1. The third resin has a glass transition temperature (Tg3) and the toner has a glass transition temperature (Tgt) where the Tg3 is higher than the Tgt.

The toner of the present embodiment can be obtained by a method including: a step of dissolving or dispersing in a solvent a resin forming a main portion, a colorant and a releasing agent, to thereby prepare a solution or dispersion liquid; a step of suspending the solution or dispersion liquid in an aqueous medium, to thereby prepare a dispersion liquid containing core particles dispersed therein; a step of adding a fine resin particle dispersion liquid, which contains fine resin particles formed of a third resin dispersed therein, to the dispersion liquid containing the core particles, to thereby form convex portions formed of the fine resin particles on a surface of each of the core particles; and a step of removing the organic solvent.

<Binder Resin>

The binder resin is not particularly limited and may be appropriately selected, as long as it includes at least the first resin and the second resin. The binder resin is preferably a resin having a polyester skeleton from the viewpoint of obtaining good fixing property. Examples of the resin having a polyester skeleton include polyester resins and block copolymers of polyesters and resins having other skeletons. Of these, polyester resins are preferably used since the obtained colored resin particles have high uniformity. Each of the main portions themselves has a sea-island structure. The convex portions form a sea-island structure with this main portion. The main portion contains incompatible compounds (e.g., wax, pigment and charge-controlling agent) to form a sea-island structure.

Notably, in the present specification, the convex portions formed of the fine resin particles on each toner particle may be referred to as a shell, and the other portion than the shell may be referred to as a core, for the sake of convenience.

<<Second Resin, Non-Crystalline Resin>>

<<<Non-Crystalline Polyester Resin>>>

The second resin is not particularly limited, so long as it is a non-crystalline resin, and may be appropriately selected depending on the intended purpose, but is preferably a non-crystalline polyester resin.

Examples of the non-crystalline polyester resin include ring-opening polymers of lactones, polycondensates of hydroxycarboxylic acid, and polycondensates of polyols and polycarboxylic acids. Of these, polycondensates of polyols and polycarboxylic acids are preferred since a wide variety of polyesters can be formed.

The peak molecular weight of the non-crystalline polyester resin is generally 1,000 to 30,000, preferably 1,500 to 10,000, more preferably 2,000 to 8,000. When the peak molecular weight is 1,000 or more, the heat resistance storage stability of the toner is good. Whereas when the peak molecular weight is 30,000 or less, the low-temperature fixing property of the toner is good.

Also, the glass transition temperature of the non-crystalline polyester resin is generally 35° C. to 80° C., preferably 40° C. to 70° C., more preferably 45° C. to 65° C. When the glass transition temperature is lower than 35° C., the obtained toner particles are deformed under high-temperature environment such as in midsummer or stick to each other. As a result, the toner particles cannot behave as particles. When the glass transition temperature is higher than 80° C., the formed toner is degraded in fixing property.

The non-crystalline polyester resin is preferably polycondensates formed between polyols (1) and polycarboxylic acids (2) listed below. These non-crystalline polyester resins may be used alone or in combination as mixtures.

—Polyol—

Examples of the polyol (1) include alkylene glycols (such as ethylene glycol, 1,2-propylene glycol, 1,3-propylene glycol, 1,4-butanediol, and 1,6-hexanediol); alkylene ether glycols (such as diethylene glycol, triethylene glycol, dipropylene glycol, polyethylene glycol, polypropylene glycol, and polytetramethylene ether glycol); alicyclic diols (such as 1,4-cyclohexane dimethanol and hydrogenated bisphenol A); bisphenols (such as bisphenol A, bisphenol F, bisphenol S, 3,3'-difluoro-4,4'-dihydroxybiphenyl, and other such 4,4'-dihydroxyphenyls); bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A), 2,2-bis(3-hydroxyphenyl)-1,1,1,3,3,3-hexafluoropropane), and other such bis(hydroxyphenyl)alkanes; bis(3-fluoro-4-hydroxyphenyl)ether and other such bis(4-hydroxyphenyl)ethers; adducts of the above-mentioned alicyclic diols with an alkylene oxide (such as ethylene oxide, propylene oxide or butylene oxide); and adducts of the above-mentioned bisphenols with an alkylene oxide (such as ethylene oxide, propylene oxide or butylene oxide).

Of these, alkylene glycols having 2 to 12 carbon atoms and adducts of a bisphenol with an alkylene oxide are preferable. Adducts of a bisphenol with an alkylene oxide, or a mixture of such an adduct and an alkylene glycol having 2 to 12 carbon atoms is particularly favorable.

Other examples include trihydric to octahydric or higher polyhydric aliphatic alcohols (such as glycerol, trimethylolethane, trimethylolpropane, pentaerythritol and sorbitol); trihydric and higher phenols (such as trisphenol PA, phenol novolac and cresol novolac); and adducts of the above-mentioned trihydric or higher polyphenols mentioned with an alkylene oxide.

These polyols may be used alone or in combination, and are not limited to what are listed above.

—Polycarboxylic Acid—

Examples of the polycarboxylic acid (2) include divalent polycarboxylic acids and tri- or higher valent polycarboxylic acids. Examples of the divalent polycarboxylic acid (2) include alkylene dicarboxylic acids (such as succinic acid, adipic acid, and sebacic acid), alkenylene dicarboxylic acids (such as maleic acid and fumaric acid), and aromatic dicarboxylic acids (such as phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride).

Of these, an alkenylene dicarboxylic acid having 4 to 20 carbon atoms, and an aromatic dicarboxylic acid having 8 to 20 carbon atoms are preferred. An aromatic polycarboxylic acid having 9 to 20 carbon atoms (such as trimellitic acid or pyromellitic acid) or an acid anhydride or a lower alkyl ester (such as methyl esters, ethyl esters or isopropyl esters) of the above, can be used as a trivalent or higher polycarboxylic acid to react with the polyol (1).

The above polycarboxylic acids may be used alone or in combination, and are not limited to what are listed above.

[Ratio of Polyol and Polycarboxylic Acid]

The ratio of the polyol (1) to the polycarboxylic acid (2), as the equivalence ratio OH/COOH of hydroxyl groups (OH) to carboxyl groups (COOH), is generally 2/1 to 1/1, preferably 1.5/1 to 1/1, more preferably 1.3/1 to 1.02/1.

[Molecular Weight of Non-Crystalline Polyester]

The peak molecular weight of the non-crystalline polyester is generally 1,000 to 30,000, preferably 1,500 to 10,000, more preferably 2,000 to 8,000. When the peak molecular weight is less than 1,000, the heat resistance degrades; whereas when it is more than 30,000, the low-temperature fixability degrades.

<<Modified Polyester Resin>>

The binder resin used in the present embodiment may contain a modified polyester resin having a urethane and/or urea group for adjusting the viscoelasticity. The amount of the modified polyester resin having a urethane and/or urea group contained in the binder resin is preferably 20% by mass or less, more preferably 15% by mass or less, still more preferably 10% by mass or less. When the amount thereof is more than 20% by mass, the low-temperature fixability is degraded. The modified polyester resin having a urethane and/or urea group may be directly mixed with the binder resin. From the viewpoint of productivity, preferably, a modified polyester resin having a relatively low molecular weight and having an isocyanate group at the end thereof (hereinafter may be referred to as "prepolymer") and an amine reactive with the prepolymer are mixed with the binder resin, and the prepolymer and the amine are allowed to undergo chain elongation and/or crosslinking reaction during or after granulation to thereby form the modified polyester resin having a urethane and/or urea group. By doing so, it is easy to incorporate the modified polyester resin having a relatively high molecular weight for adjusting the viscoelasticity.

—Prepolymer—

The prepolymer having an isocyanate group is, for example, one obtained by subjecting (1) a polyol and (2) a polycarboxylic acid to polycondensation to obtain a polyester having active hydrogen groups, and then reacting this with (3) a polyisocyanate. Examples of the above active hydrogen groups the polyester has include hydroxyl groups (alcoholic hydroxyl groups and phenolic hydroxyl groups), amino groups, carboxyl groups and mercapto groups. Of these, alcoholic hydroxyl groups are preferred.

—Polyisocyanate—

Examples of the polyisocyanate (3) include aliphatic polyisocyanates (such as tetramethylene diisocyanate, hexamethylene diisocyanate and 2,6-diisocyanate methylcaproate); alicyclic polyisocyanates (such as isophorone diisocyanate and cyclohexylmethane diisocyanate); aromatic diisocyanates (such as tolylene diisocyanate and diphenylmethane diisocyanate); aromatic aliphatic diisocyanates (such as α,α,α',α'-tetramethyl xylylene diisocyanate); isocyanurates; and blocked polyisocyanates in which the above polyisocyanates are blocked with a phenol derivative, an oxime or a caprolactam. These may be used alone or in combination.

[Ratio of Isocyanate Groups to Hydroxyl Groups]

The ratio of the polyisocyanate (3), as isocyanate groups (NCO) to hydroxyl groups (OH) of the polyester having hydroxyl groups, is generally 5/1 to 1/1, preferably from 4/1 to 1.2/1, more preferably 2.5/1 to 1.5/1. When NCO/OH is more than 5, the low-temperature fixability of the toner degrades, but when the molar ratio of NCO is less than 1, the urea content in the modified polyester is so low that hot offset resistance is poor. The amount in which the constituent components of the polyisocyanate (3) are contained in the prepolymer (A) having an isocyanate group at its terminal is generally 0.5% by mass to 40% by mass, preferably 1% by mass to 30% by mass, more preferably 2% by mass to 20% by mass. When the amount is less than 0.5% by mass, the offset resistance will degrade. When the amount is more than 40% by mass, the low-temperature fixability will degrade.

[Number of Isocyanate Groups in Prepolymer]

The number of isocyanate groups included per molecule of the prepolymer (A) having isocyanate groups is generally 1 or more, preferably from 1.5 to 3 on average, and more preferably from 1.8 to 2.5 on average. When the number is less than 1 per molecule, the molecular weight of the modified polyester will be lower after chain elongation and/or crosslinking, and offset resistance will degrade.

—Chain Elongation Agent and/or Crosslinking Agent—

An amine can be used as a chain elongation agent and/or crosslinking agent. Examples of the amine (B) include diamines (B1), trivalent or higher polyamines (B2), amino alcohols (B3), amino mercaptans (B4), amino acids (B5), and blocked amines (B6) in which the amines B1 to B5 are blocked.

Examples of the diamines B1 include: aromatic diamines (such as phenylenediamine, diethyltoluenediamine, 4,4'-diaminodiphenylmethane, tetrafluoro-p-xylylenediamine, and tetrafluoro-p-phenylenediamine); alicyclic diamines (such as 4,4'-diamino-3,3'-dimethyldicyclohexylmethane, diaminocyclohexane, and isophoronediamine); and aliphatic diamines (such as ethylenediamine, tetramethylenediamine, hexamethylenediamine, dodecafluorohexylenediamine and tetracosafluorododecylene diamine).

Examples of the trivalent or higher polyamines B2 include diethylenetriamine and triethylenetetramine.

Examples of the amino alcohols B3 include ethanolamine, and hydroxyethyl aniline.

Examples of the amino mercaptans B4 include aminoethyl mercaptan and aminopropyl mercaptan.

Examples of the amino acids B5 include aminopropionic acid and aminocaproic acid.

Examples of the blocked amines B6 in which the amines B1 to B5 are blocked include oxazoline compounds and ketimine compounds obtained from one of the above amines B1 to B5 and a ketone (such as acetone, methyl ethyl ketone, or methyl isobutyl ketone).

—Terminating Agent—

The molecular weight of the modified polyester resin upon completion of the reaction can be adjusted as necessary using a reaction terminating agent for chain elongation and/or crosslinking reaction. Examples of the terminating agent include monoamines (such as diethylamine, dibutylamine, butylamine, and laurylamine) and blocked amines (ketimine compounds) obtained by blocking the above monoamines.

[Ratio of Amino Groups to Isocyanate Groups]

The ratio of the amine B, as the equivalence ratio NCO/NHx of isocyanate groups (NCO) in the prepolymer A having isocyanate groups to amino groups (NHx) in the amine B, is generally 1/2 to 2/1, preferably 1.5/1 to 1/1.5, more preferably 1.2/1 to 1/1.2. When the NCO/NHx is greater than 2 or less than ½, the molecular weight of the urea-modified polyester (i) is low and the hot offset resistance degrades.

<<First Resin, Crystalline Resin>>

<<<Crystalline Polyester Resin>>>

The first resin is not particularly limited, so long as it is a crystalline resin, and may be appropriately selected depending on the intended purpose, but is preferably a crystalline polyester resin.

The toner of the present embodiment contains the crystalline polyester resin for improving the low-temperature fixability thereof. The crystalline polyester resin is also produced as polycondensates between the above-listed polyols and polycarboxylic acids. The polyol is preferably an aliphatic diol. Specific examples thereof include ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol and 1,4-butenediol, with 1,4-butanediol, 1,6-hexanediol and 1,8-octanediol being preferred, with 1,6-hexanediol being still more preferred. The polycarboxylic acid is preferably an aromatic dicarboxylic acid such as phthalic acid, isophthalic acid or terephthalic acid, or a C2-C8 aliphatic carboxylic acid. In order to increase the crystallinity, an aliphatic carboxylic acid is more preferred.

Notably, the crystalline resin (crystalline polyester) and the non-crystalline resin (non-crystalline polyester) are distinguished from each other in based on thermal characteristics. The crystalline resin refers to a resin having a clear endothermic peak through, for example, DSC measurement as can be seen in wax. The non-crystalline resin shows a smooth curve attributed to glass transition.

<Fine Resin Particles>

The fine resin particles are made of a third resin.

<<Third Resin, Non-Crystalline Resin>>

<<<Vinyl Resin>>>

The third resin is not particularly limited, so long as it is a non-crystalline resin, and may be appropriately selected depending on the intended purpose, but is preferably a vinyl resin.

The fine resin particles made of vinyl resin are obtained by polymerizing a monomer mixture mainly containing as a monomer an aromatic compound having a vinyl polymerizable functional group. The monomer mixture preferably contains 80% by mass to 99% by mass of the aromatic compound monomer having a vinyl polymerizable functional group and 1% by mass to 20% by mass of an acryl monomer.

The amount of the aromatic compound monomer having a vinyl polymerizable functional group contained in the monomer mixture is preferably 80% by mass to 99% by mass, more preferably 90% by mass to 99% by mass, particularly preferably 95% by mass to 99% by mass. When the amount of the aromatic compound monomer having a vinyl polymerizable functional group is less than 80% by mass, the obtained toner has poor chargeability.

Examples of the polymerizable functional group in the aromatic compound having a vinyl polymerizable functional group include a vinyl group, an isopropenyl group, an allyl group, an acryloyl group and a methacryloyl group.

Specific examples of the monomer include styrene, α-methylstyrene, 4-methylstyrene, 4-ethylstyrene, 4-tert-butylstyrene, 4-methoxystyrene, 4-ethoxystyrene, 4-carboxystyrene and metal salts thereof, 4-styrenesulfonic acid and metal salts thereof; 1-vinylnaphthalene, 2-vinylnaphthalene, allylbenzene, phenoxyalkylene glycol acrylate, phenoxyalkylene glycol methacrylate, phenoxypolyalkylene glycol acrylates and phenoxypolyalkylene glycol methacrylates.

Of these, preferably, styrene is mainly used since it is easily available, and has excellent reactivity and high chargeability.

The monomer mixture preferably contains 80% by mass to 99% by mass of styrene and 1% by mass to 20% by mass of butyl acrylate, with the total amount of the styrene and the butyl acrylate contained in the monomer mixture being 90% by mass to 100% by mass.

Also, the vinyl resin used in the present embodiment may contain 0% by mass to 7% by mass in the monomer mixture of a compound having an acid group in addition to the vinyl polymerizable functional group (hereinafter may be referred to as an "acid monomer"). The amount the acid monomer is preferably 0% by mass to 4% by mass, more preferably 0% by mass; i.e., no acid monomer is contained. When the amount thereof exceeds 7% by mass, the obtained vinyl fine resin particles themselves have high dispersion stability. Thus, when such vinyl fine resin particles are added to the dispersion liquid containing oil droplets dispersed in the aqueous phase, they are difficult to attach thereonto at ambient temperature. Or, even when the vinyl fine resin particles have been attached thereonto, they are exfoliated through the process of solvent removal, washing, drying and treating with external additives. Whereas when the amount thereof is 4% by mass or less, the obtained toner less changes in chargeability depending on the working environment.

Examples of the acid group in the compound having an acid group in addition to the vinyl polymerizable functional group include carboxylic acid, sulfonic acid and phosphoric acid.

Examples of the compound having an acid group in addition to the vinyl polymerizable functional group include carboxyl group-containing vinyl monomers and salts thereof (e.g., (meth)acrylic acid, maleic acid or maleic anhydride, monoalkyl maleates, fumaric acid, monoalkyl fumarates, crotonic acid, itaconic acid, monoalkyl itaconate, glycol itaconate monoethers, citraconic acid, monoalkyl citraconates and cinnamic acid), sulfonic acid group-containing vinyl monomers and salts thereof, vinyl-based sulfuric acid monoesters and salts thereof, and phosphoric acid group-containing vinyl monomers and salts thereof. Of these, preferred are (meth) acrylic acid, maleic acid or maleic anhydride, monoalkyl maleates, fumaric acid and monoalkyl fumarates.

When the third resin has high compatibility with the resin of the core, the formed toner cannot have desired surface conditions in some cases. Thus, it is better to control the polarity and the structure of the monomer mixture and the resin of the core so that the compatibility therebetween becomes lower.

There is used an organic solvent that does not dissolve the monomer and resin more than necessary. When the organic solvent dissolves them to such an extent that the shape of particles cannot be kept, the formed toner cannot have desired surface conditions in some cases.

The method for obtaining the fine resin particles is not particularly limited, and exemplified by the following methods (a) to (f):

(a) a method in which a monomer mixture is allowed to undergone polymerization reaction with a suspension polymerization method, an emulsification polymerization method, a seed polymerization method or a dispersion polymerization method, to thereby produce a dispersion liquid of vinyl fine resin particles;

(b) a method in which a monomer mixture is allowed to undergone polymerization, and the obtained resin is then pulverized using a fine pulverizer of, for example, mechanically rotating type or jetting type, followed by classifying, to thereby produce fine resin particles;

(c) a method in which a monomer mixture is allowed to undergone polymerization, and the obtained resin is then dissolved in a solvent, followed by spraying of the resultant resin solution, to thereby produce fine resin particles;

(d) a method in which a monomer mixture is allowed to undergone polymerization, the obtained resin is dissolved in a solvent, another solvent is added to the resultant resin solution to precipitate fine resin particles, and then the solvent is removed to obtain fine resin particles; or a method in which a monomer mixture is allowed to undergone polymerization, the obtained resin is dissolved in a solvent with heating, the resultant resin solution is cooled to precipitate fine resin particles, and then the solvent is removed to obtain fine resin particles;

(e) a method in which a monomer mixture is allowed to undergone polymerization, the obtained resin is dissolved in a solvent, the resultant resin solution is dispersed in an aqueous medium in the presence of an appropriate dispersing agent, and then the dispersion liquid is, for example, heated or left under reduced pressure; and (f) a method in which a monomer mixture is allowed to undergone polymerization, the obtained resin is dissolved in a solvent, an appropriate emulsifying agent is dissolved in the resultant resin solution, followed by phase-transfer emulsification with the addition of water.

Of these, method (a) is preferably employed, since vinyl fine resin particles can be easily produced as a dispersion liquid, which is easy to use for the next step.

In the polymerization reaction of method (a), preferably, (i) a dispersion stabilizer is added to the aqueous medium, (ii) the monomer mixture to be allowed to undergone polymerization reaction is made to contain a monomer capable of imparting dispersion stability to the fine resin particles obtained through polymerization (i.e., a reactive emulsifier)

or the above (i) and (ii) are performed in combination, to thereby impart dispersion stability to the obtained vinyl fine resin particles. When neither the dispersion stabilizer nor the reactive emulsifier is used, the particles cannot be maintained in a dispersion state whereby the vinyl resin cannot be obtained as fine particles, the obtained fine resin particles are poor in dispersion stability whereby they are poor in storage stability resulting in aggregation during storage, or the particles are degraded in dispersion stability at the below-described fine resin particle-attaching step whereby the core particles easily aggregate or combine together resulting in that the finally obtained toner is degraded in evenness of particle diameter, shape and surface, which is not preferred.

The weight average molecular weight of the vinyl resin is preferably 3,000 to 300,000, more preferably 4,000 to 100,000, particularly preferably 5,000 to 50,000. When the weight average molecular weight is lower than 3,000, the vinyl resin has low mechanical strength (i.e., is brittle). Thus, the surfaces of the finally obtained toner easily change depending on the working environment of some applications. For example, the toner considerably changes in chargeability and/or causes contamination such as attachment onto the surrounding members, which leads to degradation of image quality. Whereas when the weight average molecular weight is higher than 300,000, the number of ends of the molecules is decreased, so that the molecular chains interact with the core particles to a less extent to degrade adhesion to the core particles, which is not preferred.

The glass transition temperature (Tg) of the vinyl resin is 40° C. or higher, preferably 50° C. or higher, more preferably 60° C. or higher. When the Tg is lower than 40° C., the finally obtained toner may be degraded in storage stability, for example, may involve blocking during storage at high temperatures.

The fine resin particles preferably have a weight average particle diameter of 50 nm to 300 nm, more preferably 80 nm to 150 nm. When the weight average particle diameter thereof is less than 50 nm, the fine resin particles cannot form satisfactory convex portions on the toner surface and as a result cannot exhibit their functions in some cases. Whereas when it is more than 300 nm, the formed convex portions are so large that the releasing agent may be prevented from exuding during fixation and the toner particles may be insufficiently fused with each other to thereby make glossiness unsatisfactory and weaken the fixation strength. When the weight average particle diameter thereof is 80 nm to 150 nm, it is advantageous in that the fine resin particles can sufficiently improve the developing function without impeding fixation.

The total surface area of the island portions (or convex portions) formed of the fine resin particles is preferably 50% to 80%, more preferably 60% to 70%, relative to the total surface area of the toner particle. When it is less than 50%, the releasing agent may contaminate members in the developing device. Whereas when it is more than 80%, the island portions may prevent the releasing agent from exuding during fixation to cause fixation failures. When the total surface area is 60% to 70%, it is advantageous in that the fine resin particles do not impede fixation and the releasing agent can be prevented from contaminating members in the developing device.

The average height of the convex portions is preferably 0.03 μm to 0.1 μm, more preferably 0.04 μm to 0.08 μm. When the average height thereof is less than 0.03 μm, the convex portions cannot sufficiently improve the developing function. In addition, as the toner particles are degraded over time, the convex portions are flattened and smoothed, resulting in that the convex portions cannot improve the developing function. Whereas when the average height thereof is more than 0.1 μm, the convex portions are so large that the releasing agent may be prevented from exuding during fixation and the toner particles may be insufficiently fused with each other to thereby make glossiness unsatisfactory and weaken the fixation strength. When the average height thereof is 0.04 μm to 0.08 μm, it is advantageous in that the convex portions do not impede fixation and do prevent the toner from being degraded over time, sufficiently improving the developing function.

Here, the "average height of the convex potions" refers to an average of the heights of the convex portions from the surface of the core particle, and can be measured with a TEM image of the cross-section of the toner.

[Glass Transition Temperature]

The glass transition temperatures of the toner, the first resin, the second resin and the third resin are not particularly limited and may be appropriately selected depending on the intended purpose, so long as the glass transition temperature (Tg2) of the second resin is higher than the melting point (Tc1) of the crystalline resin (i.e., Tg2>Tc1) and the glass transition temperature (Tg3) of the third resin is higher than the glass transition temperature (Tgt) of the toner (i.e., Tg3>Tgt). Preferably, Tc1 is higher than Tgt (i.e., Tc1>Tgt) for the following reasons. Specifically, the toner production steps subsequent to the formation of toner base particles (after the washing step) and the developing step of an electrophotographic process are designed to be conducted at a temperature of lower than Tgt. When Tgt is higher than Tc1 (i.e., Tgt>Tc1), the temperature lower than Tgt may be equal to or higher than Tc1 and as a result the first resin may melt to exude on the toner surface, contaminating members. From the viewpoint of preventing such a failure, Tc1 is preferably higher than Tgt.

Among the Tg2, Tg3, Tgt and Tc1, the difference ΔT between the maximum value and the minimum value is preferably more than 0° C. but less than 10° C. (i.e., 0° C.<ΔT<10° C.) since the above-described failure does not occur and also the first resin plasticizes the second resin to improve the fixation strength and the third resin can be prevented from impeding fixation.

The glass transition temperature can be measured with a differential scanning calorimeter (e.g., DSC-6220R, product of Seiko Instruments Inc.) in the following manner, for example. First, a measurement sample is heated from room temperature to 150° C. at a temperature rising rate of 10° C./min. Then, the measurement sample is left to stand at 150° C. for 10 min and cooled to room temperature, followed by being left for 10 min. The measurement sample is heated again to 150° C. at a temperature rising rate of 10° C./min. In the obtained DSC curve, the glass transition temperature is determined as the intersection formed between the base line equal to or lower than the glass transition temperature, and the tangential line of the curve representing glass transition.

However, when the glass transition temperature of the toner is measured by the above-described method, the measurement may be inaccurate due to overlapping with the melting heat curve of the releasing agent contained in the toner. In the present invention, the glass transition temperature of the toner and resin are measurements (TgA) obtained using the below-described flow tester.

—Dispersion Stabilizer—

Examples of the dispersion stabilizer include a surfactant and an inorganic dispersing agent. Examples of the surfactant include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine. Examples of the inorganic dispersing agent include tricalcium phosphate, calcium carbonate, titanium oxide, colloidal silica and hydroxyapatite.

—Chain Transfer Agent—

In producing fine resin particles in the present embodiment, a commonly-used chain transfer agent may be used for controlling their molecular weight. The chain transfer agent is not particularly limited but is preferably an alkylmercaptan chain transfer agent having a hydrocarbon group with three or more carbon atoms. Such an alkylmercaptan chain transfer agent having a hydrocarbon group with three or more carbon atoms is not particularly limited. Examples thereof include butanethiol, octanethil, decanethiol, dodecanethiol, hexadecanethiol, octanedecanethiol, cyclohexylmercaptane, thiophenol, octyl thioglycolate, octyl 2-mercaptopropionate, octyl 3-mercaptopropionate, 2-ethylhexyl mercaptopropionate, 2-mercaptoethyl octanoate, 1,8-dimercapto-3,6-dioxaoctane, decanetrithiol and dodecyl mercaptane. In this case, hydrophobic chain transfer agents may be used alone or in combination as mixtures.

The amount of the chain transfer agent used is not particularly limited so long as it is such an amount as to control the obtained copolymer to have a desired molecular weight. The amount the chain transfer agent is preferably 0.01 parts by mass to 30 parts by mass, more preferably 0.1 parts by mass to 25 parts by mass, relative to the total amount by mole of the monomers. When the amount of the chain transfer agent is less than 0.01 parts by mass, the molecular weight of the obtained copolymer becomes too large. As a result, the fixability may decrease and/or the copolymer may gellate during the polymerization reaction. Whereas when the amount of the chain transfer agent is more than 30 parts by mass, the unreacted chain transfer agent remains and the obtained copolymer has a low molecular weight, causing contamination of members.

<Colorant>

Any known dyes and pigments can be used as colorants in the present embodiment. Examples thereof include carbon black, Nigrosine dyes, black iron oxide, Naphthol Yellow S, Hansa Yellow (10G, 5G, and G), Cadmium Yellow, yellow iron oxide, loess, chrome yellow, titanium yellow, polyazo yellow, Oil Yellow, Hansa Yellow (GR, A, RN, and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL, and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, Perinone Orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and mixtures of these. The colorant content in the toner is generally 1% by mass to 15% by mass, preferably 3% by mass to 10% by mass, with respect to the toner.

<Releasing Agent>

Known releasing agents can be used in the present embodiment. Examples of the releasing agent include polyolefin waxes (e.g., polyethylene wax and polypropylene wax); long-chain hydrocarbons (e.g., paraffin waxes, Fischer-Tropsch waxes, and SASOL wax); and carbonyl group-containing waxes.

Examples of the carbonyl group-containing wax include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone). Among them, polyolefin waxes are preferred since they have a low polarity and a low melt viscosity. Particularly preferred are paraffin waxes, Fischer-Tropsch waxes and polyethylene waxes since they are long-chain hydrocarbons.

<<External Additives>>

—Inorganic Fine Particles—

Inorganic fine particles can be used favorably as an external additive for augmenting the fluidity, developing property, and chargeability of the colorant particles that are obtained in the present embodiment. The primary particle size of these inorganic fine particles is preferably 5 nm to 2 μm, and more preferably 5 nm to 500 nm. The specific surface area as measured by BET method is preferably 20 $m^2/g$ to 500 $m^2/g$. The proportion in which these inorganic fine particles are used is preferably 0.01% by mass to 5% by mass, more preferably 0.01% by mass to 2.0% by mass, with respect to the toner. Specific examples of the inorganic fine particles include silica, alumina, titanium oxide, barium titanate, magnesium titanate, calcium titanate, strontium titanate, zinc oxide, tin oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

—Polymeric Fine Particles—

In addition, polymeric particles may be used, such as methacrylic ester or acrylic ester copolymers or polystyrene obtained by soap-free emulsion polymerization or dispersion polymerization; polycondensates of silicone, benzoguanamine or nylon; and polymer particles produced from thermosetting resins.

[Surface Treatment of External Additive]

Such fluidizers can be surface-treated to make them hydrophobic, which prevents the fluidity and charge properties from being adversely affected even under high humidity. Preferable examples of the surface treatment agent for the external additives include silane coupling agents, silylation agents, silane coupling agents including a fluoroalkyl group, organic titanate-based coupling agents, aluminum-based coupling agents, silicone oils, and modified silicone oils.

<<Cleaning Auxiliary>>

A cleaning auxiliary may be used to remove any developer remaining after transfer on a photosensitive member or a primary transfer medium. Examples of thereof include zinc stearate, calcium stearate, stearic acid, and other such fatty acids and metal salts thereof; and polymer fine particles manufactured by a soap-free emulsion polymerization method, such as polymethyl methacrylate fine particles and polystyrene fine particles. The polymer fine particles preferably have a relatively narrow particle size distribution and a volume average particle size of from 0.01 μm to 1 μm.

(Method for Producing Toner)

A method of the present invention for producing a toner includes at least the following steps (1) to (4):

(1) a step of dissolving or dispersing in an organic solvent at least a first resin, a second resin, a releasing agent and a colorant, to thereby prepare a solution or dispersion liquid where the first resin is a crystalline resin and the second resin is a non-crystalline resin (a dissolving or dispersing step);

(2) a step of suspending the solution or dispersion liquid in an aqueous medium, to thereby prepare a dispersion liquid containing core particles dispersed therein, where each core particle contains at least the first resin, the second resin, the releasing agent and the colorant (a core particle dispersion liquid preparation step);

(3) a step of adding a fine resin particle dispersion liquid, which contains fine resin particles formed of a third resin dispersed therein, to the dispersion liquid containing the core particles, to thereby form convex portions formed of the fine resin particles on a surface of each of the core particles where the third resin is a non-crystalline resin, the second resin has a glass transition temperature (Tg2) and the crystalline resin has a melting point (Tc1) where the glass transition temperature (Tg2) is higher than the melting point (Tc1), and the third resin has a glass transition temperature (Tg3) and the toner has a glass transition temperature (Tgt) where the glass transition temperature (Tg3) is higher than the glass transition temperature (Tgt) (a convex portions formation step); and (4) a step of removing the organic solvent (organic solvent removal step).

One example of the toner production method of the present embodiment will next be described. However, the toner production method able to be made should not be construed as being limited thereto.

<Dissolving or Dispersing Step>

—Organic Solvent—

The organic solvent is preferably a volatile organic solvent having a boiling point lower than 100° C. from the viewpoint of easily removing the solvent. Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. Particularly preferred are esters such as methyl ester and ethyl ester, aromatic solvents such as toluene and xylene, and halogenated hydrocarbons such as methylene chloride, 1,2-dichloroethane, chloroform and carbon tetrachloride. The polyester resin and the colorant may be dissolved or dispersed therein at the same time. In general, they are individually dissolved or dispersed. The organic solvent used for dissolving or dispersing them may be different or the same. However, the same organic solvent is preferably used considering the subsequent removal of the solvent. The releasing agent preferably used in the present embodiment hardly dissolves in a single solvent or a mixed solvent that suitably dissolves the polyester resin due to the difference in their solubility.

The oil phase, which contains an organic solvent and a resin, a colorant, a releasing agent and other materials dissolved or dispersed in the organic solvent, may be prepared in the following manner. Specifically, the resin, the colorant and other materials are gradually added to the organic solvent under stirring so that these materials are dissolved or dispersed therein. Notably, when a pigment is used as the colorant and/or when the releasing agent, the charge controlling agent, and other materials used are poorly dissolvable to the organic solvent, the particles of these materials are preferably micronized before the addition to the organic solvent.

As described above, the colorant may be formed into a masterbatch. Similarly, the releasing agent, the charge controlling agent, and other materials may be formed into a masterbatch.

In another means, the colorant, the releasing agent and the charge controlling agent may be dispersed through a wet process in the organic solvent, if necessary in the presence of a dispersion aid, to thereby obtain a wet master.

In still another means, when dispersing the materials melted at a temperature lower than the boiling point of the organic solvent, they are heated under stirring in the organic solvent, if necessary in the presence of a dispersion aid to be stirred together with the dispersoids; and the resultant solution is cooled with stirring or shearing so that the dissolved materials are crystallized, to thereby produce microcrystals of the dispersoids.

After the colorant, releasing agent and charge controlling agent, dispersed with any of the above means, have been dissolved or dispersed in the organic solvent together with a resin, the resultant mixture may be further dispersed. The dispersion may be performed using a known disperser such as a bead mill or a disc mill.

[Dissolution or Dispersion of Polyester Resin]

The solution or dispersion liquid of the polyester resin preferably has a resin concentration of about 40% by mass to about 80% by mass. When the resin concentration is too high, the polyester resin becomes difficult to dissolve or disperse. Also, the solution or dispersion liquid increases in viscosity and as a result its handleability thereof is degraded. When the resin concentration is too low, the amount of fine particles produced becomes small and the amount of the solvent to be removed becomes large. When the modified polyester resin having an isocyanate group at the end thereof is mixed with the polyester resin, they may be mixed together in the same solution or dispersion liquid, or separate solutions or dispersion liquids thereof may be prepared. Considering their solubilities and viscosities, it is preferable to prepare separate solutions or dispersion liquids of the polyester resin and the modified polyester resin having an isocyanate group at the end thereof.

<Core Particle Dispersion Liquid Preparation Step>

—Aqueous Medium—

Water alone can be used as the aqueous medium, but a solvent which can be mixed with water can also be used. Examples of such miscible solvents include alcohols (such as methanol, isopropanol and ethylene glycol), dimethylformamide, tetrahydrofuran, cellosolves (such as methyl cellosolve), and lower ketones (such as acetone and methyl ethyl ketone). The amount of the aqueous medium used is generally 50 parts by mass to 2,000 parts by mass, preferably 100 parts by mass to 1,000 parts by mass, per 100 parts by mass of the resin fine particles.

No particular limitation is imposed on the method for preparing a dispersion liquid containing core particles formed of the oil phase by dispersing the oil phase obtained at the above-described step in the aqueous medium. This method may use a known disperser such as a low-speed shearing disperser, a high-speed shearing disperser, a friction disperser, a high-pressure jet disperser or an ultrasonic disperser. Among them, a high-speed shearing disperser is preferably used to form dispersoids having a particle diameter of 2 μm to 20 μm. The rotation speed of the high-speed shearing disperser is not particularly limited but is generally 1,000 rpm to 30,000 rpm, preferably 5,000 rpm to 20,000 rpm. The dispersion time is not particularly limited but is generally 0.1 min to 5 min in a batch method. When the dispersion time exceeds 5 min, unfavorable small particles remain and excessive dispersion is performed to make the dispersion system unstable, potentially forming aggregates and coarse particles, which is not preferred. The dispersion temperature is generally 0° C. to 40° C., preferably 10° C. to 30° C. Under pressure, it is generally 0° C. to 150° C., preferably 20° C. to 80° C. When the dispersion temperature exceeds 40° C., molecular movements are excited to degrade dispersion stability, easily forming aggregates and coarse particles, which is not preferred. Whereas when the dispersion temperature is lower than 0° C., the dispersion liquid is increased in viscosity to require elevated energy for dispersion, leading to a drop in production efficiency.

—Inorganic Dispersing Agent and Fine Organic Resin Particles—

In dispersing in the aqueous medium the solution or dispersion liquid of the polyester resin and releasing agent, an inorganic dispersing agent or fine organic resin particles are preferably dispersed in the aqueous medium in advance, since the particle size distribution becomes sharp and the dispersion state becomes stable. Examples of the inorganic dispersing agent include tricalcium phosphate, calcium carbonate, titanium oxide, colloidal silica and hydroxyapatite. The resin of the fine organic resin particles may be any resin so long as it can form aqueous dispersoids. It may be a thermoplastic resin or a thermosetting resin. Examples thereof include vinyl resins, polyurethane resins, epoxy resins, polyester resins, polyamide resins, polyimide resins, silicone resins, phenol resins, melamine resins, urea resins, aniline resins, ionomer resins and polycarbonate resins. These resins may be used alone or in combination. Among them, polyurethane resins, epoxy resins, polyester resins and mixtures thereof are preferred from the viewpoint of easily obtaining aqueous dispersoids of fine spherical resin particles.

—Surfactant—

If necessary, a surfactant may be used in preparing the core particle dispersion liquid.

Examples of surfactants include anionic surfactants such as alkylbenzenesulfonates, α-olefin sulfonates, and phosphoric acid esters; cationic surfactants such as amine salts (such as alkyl amine salts, aminoalcohol fatty acid derivatives, polyamine fatty acid derivatives, and imidazoline), and quaternary ammonium salts (such as alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amine derivatives and polyhydric alcohol derivatives; and amphoteric surfactants such as alanine, dodecyldi (aminoethyl)glycine, di(octylaminoethyl)glycine, and N-alkyl-N,N-dimethylammonium betaine.

By using a surfactant having a fluoroalkyl group, the effect of the surfactant can be achieved by using on a small amount thereof. Examples of anionic surfactants having a fluoroalkyl group and that can be used favorably include fluoroalkyl carboxylic acids having from 2 to 10 carbon atoms and metal salts thereof, disodium perfluorooctanesulfonyl glutamate, sodium 3-[ω-fluoroalkanoyl (having 6 to 11 carbon atoms, hereinafter referred to as, for example, "$C_6$-$C_{11}$")oxy]-1-alkyl($C_3$-$C_4$)sulfonate, sodium 3-[ω-fluoroalkanoyl($C_6$-$C_8$)—N-ethylamino]-1-propanesulfonate, fluoroalkyl($C_{11}$-$C_{20}$)carboxylic acid and metal salts thereof, perfluoroalkyl ($C_7$-$C_{13}$)carboxylic acid and metal salts thereof, perfluoroalkyl($C_4$-$C_{12}$)sulfonic acid and metal salts thereof, perfluorooctanesulfonic acid diethanol amide, N-propyl-N-(2-hydroxyethyl)perfluorooctanesulfone amide, perfluoroalkyl($C_6$-$C_{10}$) sulfonamide propyl trimethyl ammonium salts, perfluoroalkyl($C_6$-$C_{10}$)—N-ethylsulfonylglycine salts, and monoperfluoroalkyl($C_6$-$C_{16}$)ethyl phosphates. Examples of cationic surfactants include primary, secondary and tertiary amines having a fluoroalkyl group, aliphatic quaternary ammonium salts such as perfluoroalkyl($C_6$-$C_{10}$)sulfonamide propyl trimethyl ammonium salts, benzalkonium salts, benzetonium chloride, pyridinium salts, and imidazolinium salts.

In order to efficiently disperse the oil droplets containing the solvent, the surfactant used is preferably a disulfonic acid salt having a relatively high HLB (Hydrophile-Lipophile Balance: the value indicating the extent of affinity of a surfactant to water or oil). The amount of the surfactant contained in the aqueous medium is preferably 1% by mass to 10% by mass, more preferably 2% by mass to 8% by mass, particularly preferably 3% by mass to 7% by mass. When the amount thereof exceeds 10% by mass, each oil droplet becomes too small and also has a reverse micellar structure. Thus, the dispersion stability is degraded due to the surfactant added in such an amount, to thereby easily form coarse oil droplets. Whereas when the amount thereof is lower than 1% by mass, the oil droplets cannot be stably dispersed to form coarse oil droplets. Needless to say, both cases are not preferred.

—Protective Colloid—

It is also possible to stabilize dispersion droplets with a polymeric protective colloid. Examples include homopolymers and copolymers of monomers such as acids (such as acrylic acid, methacrylic acid, α-cyanoacrylic acid, α-cyanomethacrylic acid, itaconic acid, crotonic acid, fumaric acid, maleic acid, and maleic anhydride), acrylic monomers having a hydroxyl group (such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerol monoacrylic acid esters, glycerol monomethacrylic acid esters, N-methylolacrylamide, and N-methylolmethacrylamide), vinyl alcohol and ethers of vinyl alcohol (such as vinyl methyl ether, vinyl ethyl ether, and vinyl propyl ether), esters of vinyl alcohol and a compound having a carboxyl group (such as vinyl acetate, vinyl propionate, and vinyl butyrate), acrylamide, methacrylamide, diacetoneacrylamide, and methylol compounds thereof, acid chlorides (such as acrylic acid chloride and methacrylic acid chloride), and monomers having a nitrogen atom or a hetero ring (such as vinyl pyridine, vinyl pyrrolidone, vinyl imidazole, and ethyleneimine); as well as compounds based on polyoxyethylene compounds (such as polyoxyethylene, polyoxypropylene, polyoxyethylene alkylamines, polyoxypropylene alkylamines, polyoxyethylene alkylamides, polyoxypropylene alkylamides, polyoxyethylene nonylphenyl ethers, polyoxyethylene lauryl phenyl ethers, polyoxyethylene stearyl phenyl esters, and polyoxyethylene nonylphenyl esters), and cellulose compounds (such as methyl cellulose, hydroxyethyl cellulose, and hydroxypropyl cellulose). When compounds such as calcium phosphate that are soluble in acids and alkalies are used as a dispersion stabilizer, the calcium phosphate is removed from the fine particles by a method such as dissolving the calcium phosphate with an acid such as hydrochloric acid and then washing with water. When a dispersing agent is used, the dispersing agent can be left on the toner particle surface, but it is preferably washed away, as this will improve the charging of the toner.

—Elongation and/or Crosslinking Reaction—

When the modified polyester resin having an isocyanate group at the end thereof and the amine reactive therewith in order to introduce a modified polyester resin having a urethane and/or urea group, the amine may be added to the oil phase before the toner composition (oil phase) is dispersed in the aqueous medium, or the amine may be added to the aqueous medium. The time required for the above reaction is selected depending on the reactivity between the amine and the isocyanate group-containing structure the polyester prepolymer has, but is generally 1 minute to 40 hours, preferably 1 hour to 24 hours. The temperature for the reaction is generally 0° C. to 150° C., preferably 20° C. to 98° C.

<Convex Portions Formation Step>

The obtained core particle dispersion liquid contains stable liquid droplets of the core particles, so long as the dispersion liquid is being stirred. For attaching the fine resin particles onto the core particles, the fine resin particle dispersion liquid is added to this core particle slurry. The fine resin particle dispersion liquid is added thereto for 30 sec or longer. When it is added for 30 sec or shorter, the dispersion system drastically changes to form aggregated particles. In addition, the fine resin particles are ununiformly attached onto the core particles, which is not preferred. Meanwhile, adding the vinyl fine resin particle dispersion liquid over an unnecessarily long period of time (e.g., 60 min or longer) is not preferred from the viewpoint of lowering production efficiency.

Before added to the core particle dispersion liquid, the vinyl fine resin particle dispersion liquid may be appropriately diluted or concentrated so as to have a desired concentration. The amount of the fine resin particles contained in the fine resin particle dispersion liquid is preferably 5% by mass to 30% by mass, more preferably 8% by mass to 20% by mass. When the amount thereof is less than 5% by mass, the concentration of the organic solvent greatly changes upon addition of the dispersion liquid to lead to insufficient attachment of the fine resin particles, which is not preferred. Also, when the amount thereof exceeds 30% by mass, the fine resin particles tend to be localized in the core particle dispersion liquid, resulting in that the fine resin particles are ununiformly attached onto the core particles, which is not preferred.

Also, the fine resin particle dispersion liquid may or may not the organic solvent. Preferably, it contains no organic solvent and contains fine resin particles in the form of solids dispersed therein.

The following may explain the reason why the fine resin particles are sufficiently firmly attached onto the core particles by the method of the present invention. Specifically, when the fine resin particles are attached onto the liquid droplets of the core particles, the core particles can freely deform to sufficiently form contact surfaces with the fine resin particles and the fine resin particles are swelled with or dissolved in the organic solvent to make it easier for the fine resin particles to adhere to the resin in the core particles. Therefore, in this state, the organic solvent must exist in the system in a sufficiently large amount. Specifically, in the core particle dispersion liquid, the amount of the organic solvent is preferably 10% by mass to 70% by mass, more preferably 30% by mass to 60% by mass, particularly preferably 40% by mass to 55% by mass, relative to the amount of the solid matter (e.g., resin, colorant, releasing agent, and if necessary, charge controlling agent). When the amount of the organic solvent exceeds 70% by mass, the amount of the toner particles obtained through one production process is reduced, resulting in low production efficiency. In addition, it is not preferred since dispersion stability is degraded to cause re-aggregation, making it difficult to perform stable production. When the amount of the organic solvent is less than 10% by mass, it becomes impossible for the fine resin particles to be sufficiently firmly attached to the core particles as described above, which is not preferred. When a preferred concentration of the organic solvent in attaching the resin particles to the core particles is lower than a preferred concentration of the organic solvent in producing the core particles, part of the organic solvent is removed after the production of the core particles to thereby adjust the concentration of the organic solvent. In this state, the resin particles are attached onto the core particles and then the organic solvent is completely removed. Here, the description "the organic solvent is completely removed" or similar descriptions (e.g., completely removing the organic solvent) mean that the organic solvent is reduced to a level that can be achieved by a known method generally used in the below-described organic solvent removal step.

The temperature at which the fine resin particles are attached to the core particles is generally 10° C. to 60° C., preferably 20° C. to 45° C. When this temperature is higher than 60° C., the required energy for the production is increased to increase the environmental load brought by the production. In addition, since low-acid-value fine vinyl resin particles are present on the surfaces of liquid droplets, the dispersion state becomes unstable to potentially form coarse particles, which is not preferred. Whereas when the above temperature is lower than 10° C., the resultant dispersion liquid is increased in viscosity, making the attachment of the fine resin particles insufficient.

<Organic Solvent Removal Step>

The organic solvent can be removed from the obtained dispersion liquid of toner particles by a known method. One employable method thereof is a method where the temperature of the reaction system is gradually increased under normal or reduced pressure to thereby completely evaporate off and remove the organic solvent contained in the liquid droplets.

It is preferred that the organic solvent is completely removed after the formation of convex portions.

<Washing and Drying Step>

A known technique is used to perform a step of washing and drying the toner particles dispersed in the aqueous medium.

Specifically, the dispersion liquid of the toner particles is separated into solid and liquid by a centrifuge or a filter press. The obtained toner cake is re-dispersed in ion-exchange water having room temperature to about 40° C. and then the pH of the dispersion liquid is optionally adjusted with an acid or an alkali, followed by separating into solid and liquid. The above process of separation and re-dispersion is repeated several times to remove impurities and surfactant. Thereafter, the obtained product is dried with, for example, an air-flow dryer, an air-circulation dryer, a reduced-pressure dryer or a vibration-flow dryer, to thereby obtain toner powder. Here, fine toner particles may be removed with a centrifuge. Also, the obtained toner powder after drying may optionally be classified using a known classifying apparatus so as to have a desired particle size distribution.

<External Addition>

The dried toner powder thus obtained is mixed with other particles, such as charge control fine particles or fluidizer fine particles, and the mixed powder may be subjected to mechanical impact to fix and fuse the particles at the surface, and prevent the other particles from falling off the surface of the composite particles thus obtained. Specific ways to accomplish this include a method in which a mixture is subjected to an impact force by blades rotating at high speed, and a method in which a mixture is put into a high-speed gas flow and accelerated, so that the particles collide with each other, or composite particles collide with a collision plate. Examples of the apparatus used for this include an Ong Mill (product of Hosokawa Micron Co., Ltd.), a modified I mill (product of Nippon Pneumatic Industries Co., Ltd.) in which the pressure of pulverization air is reduced, a Hybridization System (product of Nara Machine Co., Ltd.), a Kryptron System (product of Kawasaki Heavy Industries Co., Ltd.) and an automatic mortars.

[Image Forming Method, Image Forming Apparatus, and Process Cartridge]

<Image Forming Apparatus and Process Cartridge>

An image forming apparatus of the present embodiment forms an image with the toner of the present embodiment. Notably, the toner of the present invention may be used as a one-component developer or a two-component developer. Preferably, the toner of the present invention is used as a one-component developer. Also, the image forming apparatus of the present invention preferably has an endless intermediate transfer unit. Further, the image forming apparatus of the present invention preferably has a cleaning unit configured to remove the toner remaining on the photoconductor and/or the intermediate transfer unit. The cleaning unit does not necessarily have to have a cleaning blade. The image forming apparatus of the present invention preferably has a fixing unit configured to fix an image with a roller or belt having a heating device. The fixing unit in the image forming apparatus of the present invention is a fixing unit having a fixing member that requires no oil application. The image forming apparatus preferably further includes appropriately selected other units such as a charge-eliminating unit, a recycling unit and a controlling unit.

The image forming apparatus of the present invention may be formed into a process cartridge, which is detachably mounted to the main body of the image forming apparatus, by incorporating together the photoconductor and the constituent members (e.g., the developing unit and the cleaning unit). Alternatively, the photoconductor and at least one of the charging unit, exposing unit, developing unit, transfer unit, separating unit and cleaning unit are supported together to form a process cartridge, which is a single unit detachably mounted to the main body of the image forming apparatus using a guide unit thereof (e.g., a rail).

Figure 2:
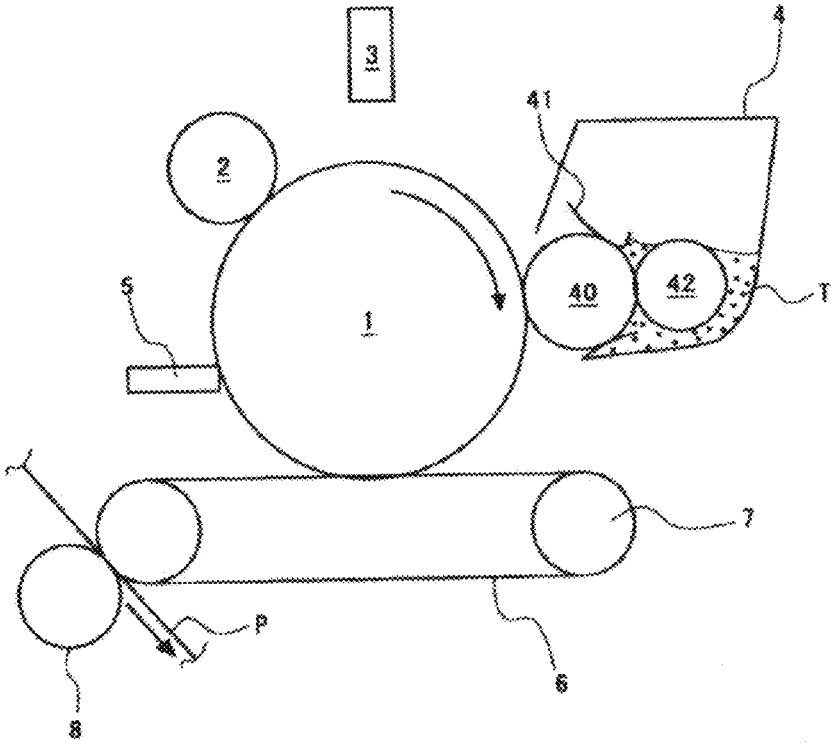
FIG. 2 is an explanatory view of essential parts of one exemplary image forming apparatus in which an electrostatic image developing toner is used.

FIG. 2 illustrates one exemplary image forming apparatus of the present invention. This image forming apparatus contains, in an unillustrated main body casing, a latent image bearing member (1) rotated clockwise in FIG. 2 which is provided therearound with a cleaning device (2), an exposing device (3), a developing device (4) having the toner (T) of the present invention, a cleaning part (5), an intermediate transfer medium (6), a supporting roller (7), a transfer roller (8) and an unillustrated charge-eliminating unit.

This image forming apparatus has an unillustrated paper-feeding cassette containing a plurality of recording paper sheets (P), which are exemplary recording media. The recording paper sheets (P) in the paper-feeding cassette are fed one by one with an unillustrated paper-feeding roller to between the intermediate transfer medium (6) and the transfer roller (8) serving as a transfer unit. Before fed to therebetween, the recording paper sheet is retained with a pair of registration rollers so that it can be fed at a desired timing.

In this image forming apparatus, while being rotated clockwise in FIG. 2, the latent image bearing member (1) is uniformly charged with the charging device (2). Then, the latent image bearing member (1) is irradiated with laser beams modulated by image date from the exposing device (3), to thereby form a latent electrostatic image. The latent electrostatic image formed on the latent image bearing member (1) is developed with the toner using the developing device (4). Next, the toner image formed with the developing device (4) is transferred from the latent image bearing member (1) to the intermediate transfer medium (6) through application of transfer bias. Separately, the recording paper sheet (P) is fed to between the intermediate transfer medium (6) and the transfer roller (8), whereby the toner image is transferred onto the recording paper sheet (P). Moreover, the recording paper sheet (P) with the toner image is conveyed to an unillustrated fixing unit.

The fixing unit has a fixing roller and a press roller, wherein the fixing roller is heated to a predetermined temperature and the press roller is pressed against the fixing roller at a predetermined pressure. The fixing unit heats and presses the recording paper sheet conveyed from the transfer roller (8), to thereby fix the toner image on the recording paper sheet, which is then discharged to an unillustrated discharge tray.

In the image forming apparatus after the above-described recording process, the latent image bearing member (1), from which the toner image has been transferred by the transfer roller (8) onto the recording paper sheet, is further rotated to reach the cleaning part (5), where the toner remaining on the surface of the latent image bearing member (1) is scraped off. Then, the latent image bearing member (1) is charge-eliminated with an unillustrated charge-eliminating device. The image forming apparatus uniformly charges, with the charging device (2), the latent image bearing member (1) which has been charge-eliminated by the charge-eliminating device, and performs the next image formation in the same manner as described above.

Next will be described in detail the members suitably used in the image forming apparatus of the present invention.

The material, shape, structure and size of the latent image bearing member (1) are not particularly limited and may be appropriately selected from those know in the art. The latent image bearing member is suitably in the form of a drum or belt, and is, for example, an inorganic photoconductor made of amorphous silicon or selenium and an organic photoconductor made of polysilane or phthalopolymethine. Of these, an amorphous silicon photoconductor or an organic photoconductor is preferred since it has a long service life.

The latent electrostatic image can be formed on the latent image bearing member (1) with a latent electrostatic image-forming unit by, for example, imagewise exposing the charged surface of the latent image bearing member (1). The latent electrostatic image-forming unit contains at least the charging device (2) which charges the surface of the latent image bearing member (1) and the exposing device (3) which imagewise exposes the surface of the latent image bearing member (1).

The charging can be performed by, for example, applying a voltage to the surface of the latent image bearing member (1) using the charging device (2).

The charging device (2) is not particularly limited and may be appropriately selected depending on the intended purpose. Examples thereof include contact-type chargers known per se having, for example, a conductive or semiconductive roller, a brush, a film and a rubber blade; and non-contact-type chargers utilizing colona discharge such as corotron and scorotron.

The charging device (2) may be a charging roller as well as a magnetic brush or a fur brush. The shape thereof may be suitably selected according to the specification or configuration of an electrophotographic apparatus. When a magnetic brush is used as the charging device, the magnetic brush is composed of a charging member of various ferrite particles such as Zn—Cu ferrite, a non-magnetic conductive sleeve to support the ferrite particles, and a magnetic roller included in the non-magnetic conductive sleeve. Also, the fur brush is, for example, a fur treated to be conductive with, for example, carbon, copper sulfide, a metal or a metal oxide, and the fur is coiled or mounted to a metal or a metal core which is treated to be conductive, thereby obtaining the charging device.

The charging device (2) is not limited to the aforementioned contact-type chargers. However, the contact-type chargers are preferably used from the viewpoint of reducing the amount of ozone generated from the charger in the image forming apparatus.

The exposing can be performed by, for example, imagewise exposing the photoconductor surface with the exposing device (3). The exposing device (3) is not particularly limited and may be appropriately selected depending on the intended purpose, so long as it attains desired imagewise exposure to the surface of the latent image bearing member (1) charged with the charging device (2). Examples thereof include various exposing devices such as a copy optical exposing device, a rod lens array exposing device, a laser optical exposing device and a liquid crystal shutter exposing device.

The developing step is a step of developing, with a toner, the latent electrostatic image formed on the surface of the latent image bearing member to form a visible image, and can be performed by, for example, developing the latent electrostatic image with the toner of the present invention using the developing device (4). The developing device (4) is not particularly limited, so long as it attains development using the toner of the present invention, and may be appropriately selected from known developing units. Preferred examples of the developing units include those having a developing device which has the toner of the present invention therein and which can apply the toner to the latent electrostatic image in a contact or non-contact manner.

The developing device (4) preferably has a developing roller (40) and a thin layer-forming member (41). Here, the developing roller (40) has a toner on the circumferential surface thereof and supplies the toner to the latent electrostatic image formed on the latent image bearing member (1) while being rotated together with the latent image bearing member (1) the developing roller (40) is in contact with. The thin layer-forming member (41) comes into contact with the circumferential surface of the developing roller (40) to form a thin layer of the toner on the developing roller (40).

The developing roller (40) used is preferably a metal roller or elastic roller. The metal roller is not particularly limited and may be appropriately selected depending on the intended purpose. Examples thereof include an aluminum roller. By treating the metal roller through blast treatment, the developing roller (40) having a desired surface friction coefficient can be formed relatively easily. Specifically, an aluminum roller can be treated through glass bead blasting to roughen the roller surface. The thus-obtained developing roller can attach an appropriate amount of toner thereonto.

The elastic roller used is a roller coated with an elastic rubber layer. The roller is further provided thereon with a surface coat layer made of a material that is easily chargeable at the opposite polarity to that of the toner. The hardness of the elastic rubber layer is set to be equal to or lower than 60° according to JIS-A, in order to prevent the toner from being degraded due to pressure concentration at a contact region between the elastic rubber layer and the thin layer-forming member (41). The surface roughness (Ra) of the elastic rubber layer is set to be 0.3 μm to 2.0 μm so as to retain, on its surface, the toner in a necessary amount. Also, since the developing roller (40) receives a developing bias for forming an electrical field between the developing roller (40) and the latent image bearing member (1), the resistance of the elastic rubber layer is set to be $10^3\Omega$ to $10^{10}\Omega$. The developing roller (40) is rotated counterclockwise to convey the toner retained thereon to positions where the developing roller (40) faces the thin layer forming member (41) and the latent image bearing member (1).

The thin layer-forming member (41) is provided upstream of the contact region between the supply roller (42) and the developing roller (40) in a direction in which the developing roller (40) is rotated. The thin layer-forming member (41) is a metal plate spring of stainless steel (SUS) or phosphor bronze, and its free end is brought into contact with the surface of the developing roller (40) at a press force of 10 N/m to 40 N/m. The thin layer-forming member (41) forms the toner passing thereunder into a thin layer by the press force and frictionally charges the toner. In addition, for aiding frictional charging, the thin layer forming member (41) receives a regulation bias having a value offset in the same direction of the polarity of the toner against the developing bias.

The rubber elastic material forming the surface of the developing roller (40) is not particularly limited and may be appropriately selected depending on the intended purpose. Examples thereof include styrene-butadiene copolymer rubbers, butadiene copolymer rubbers, acrylonitrile-butadiene copolymer rubbers, acrylic rubbers, epichlorohydrin rubbers, urethane rubbers, silicone rubbers and blends of two or more of them. Of these, particularly preferred are blend rubbers of epichlorohydrin rubbers and acrylonitrile-butadiene copolymer rubbers.

The developing roller (40) is produced by, for example, coating the circumference of a conductive shaft with the rubber elastic material. The conductive shaft is made, for example, of a metal such as stainless steel (SUS).

The transfer can be performed by, for example, charging the latent image bearing member (1) with a transfer roller. The transfer roller preferably has a primary transfer unit configured to transfer the toner image onto the intermediate transfer medium (6) to form a transfer image; and a secondary transfer unit (transfer roller (8)) configured to transfer the transfer image onto a recording paper sheet (P). More preferably, in response to the case where toners of two or more colors, preferably, full color toners are used, the transfer roller has a primary transfer unit configured to transfer the toner images onto the intermediate transfer medium (6) to form a composite transfer image; and a secondary transfer unit configured to transfer the composite transfer image onto a recording paper sheet (P).

Notably, the intermediate transfer medium (6) is not particularly limited and may be appropriately selected from known transfer media. Preferred examples thereof include a transfer belt.

The transfer unit (the primary transfer unit or the secondary transfer unit) preferably has at least a transfer device which charge-separates the toner image from the latent image bearing member (1) toward the recording paper sheet (P). The number of the transfer unit may be one or more. Examples of the transfer unit include a corona transfer device using colona discharge, a transfer belt, a transfer roller, a pressure transfer roller and an adhesive transfer device.

Notably, typical examples of the recording paper sheet (P) include plain paper. The recording paper sheet, however, is not particularly limited and may be appropriately selected depending on the intended purpose, so long as it can receive an unfixed image formed after development. Further examples of the recording paper sheet employable include PET bases for use in OHP.

The fixing can be performed by, for example, fixing the toner image transferred onto the recording paper sheet (P) with a fixing unit. The fixing of the toner images of colors may be performed every time when each toner image is transferred onto the recording paper sheet (P) or at one time after the toner images of colors have been mutually superposed.

The fixing unit is not particularly limited and may be appropriately selected depending on the intended purpose. The fixing unit is preferably a known heat-press unit. Examples of the heat-press unit include a combination of a heating roller and a pressing roller and a combination of a heating roller, a pressing roller and an endless belt. Notably, the heating temperature of the heat-press unit is preferably 80° C. to 200° C.

Figure 3:
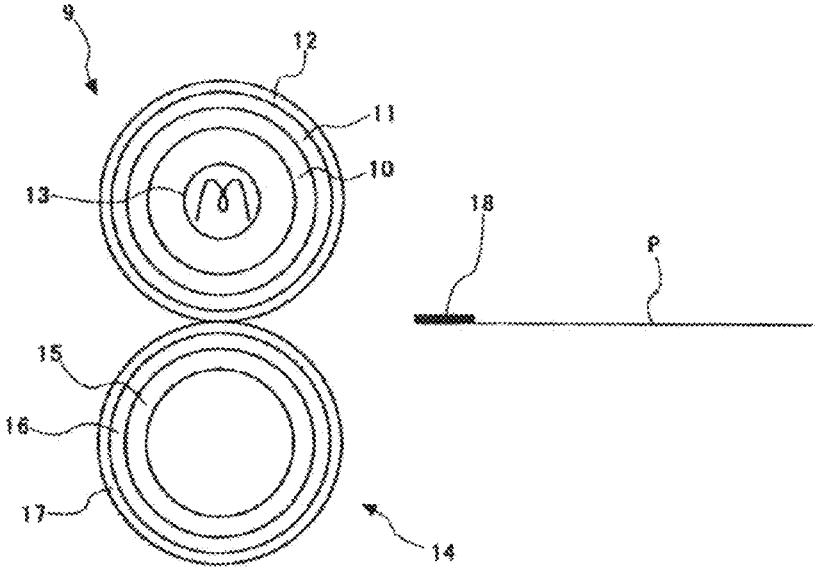
FIG. 3 illustrates one exemplary configuration of a fixing device in an image forming apparatus in which an electrostatic image developing toner is used.

The fixing device may be a soft roller-type fixing unit having fluorine-containing surface layers as shown in FIG. 3. This fixing device has a heat roller (9) and a press roller (14). The heat roller (9) has an aluminum core (10), an elastic material layer (11) of silicone rubber, PFA (tetrafluoroethylene-perfluoroalkyl vinyl ether copolymer) surface layer (12) and a heater (13), where the elastic material layer (11) and the PFA surface layer (12) are provided on the aluminum core (10) and the heater (13) is provided inside the aluminum core (10). The press roller (14) has an aluminum core (15), an elastic material layer (16) of silicone rubber and a PFA surface layer (17), where the elastic material layer (16) and the PFA surface layer (17) are provided on the aluminum core (15). Notably, the recording paper sheet (P) having an unfixed image (18) is fed as illustrated.

Notably, in the present invention, a known optical fixing device may be used in addition to or instead of the fixing unit depending on the intended purpose.

Charge elimination is preferably performed by, for example, applying a charge-eliminating bias to the latent image bearing member with a charge-eliminating unit. The charge-eliminating unit is not particularly limited, so long as it can apply a charge-eliminating bias to the latent image bearing member, and may be appropriately selected from known charge-eliminating devices. Preferably, a charge-eliminating lamp or a similar device is used.

Cleaning is preferably performed by, for example, removing the toner remaining on the photoconductor with a cleaning unit. The cleaning unit is not particularly limited, so long as it can remove the toner remaining on the photoconductor, and may be appropriately selected from known cleaners. Preferred examples thereof include a magnetic blush cleaner, an electrostatic brush cleaner, a magnetic roller cleaner, a blade cleaner, a brush cleaner and a web cleaner.

Recycling is preferably performed by, for example, conveying the toner having been removed by the cleaning unit to the developing unit with a recycling unit. The recycling unit is not particularly limited and may be, for example, a known conveying unit.

Control is preferably performed by, for example, controlling each unit with a controlling unit. The controlling unit is not particularly limited, so long as it can control each unit, and may be appropriately selected depending on the intended purpose. Examples thereof include devices such as a sequencer and a computer.

The image forming apparatus, image forming method or process cartridge of the present invention uses the latent electrostatic image developing toner in fixing property and involving no degradation (e.g., cracks) due to stress in the developing process, and thus can provide good images.

<Multi-Color Image Forming Apparatus>

Figure 4:
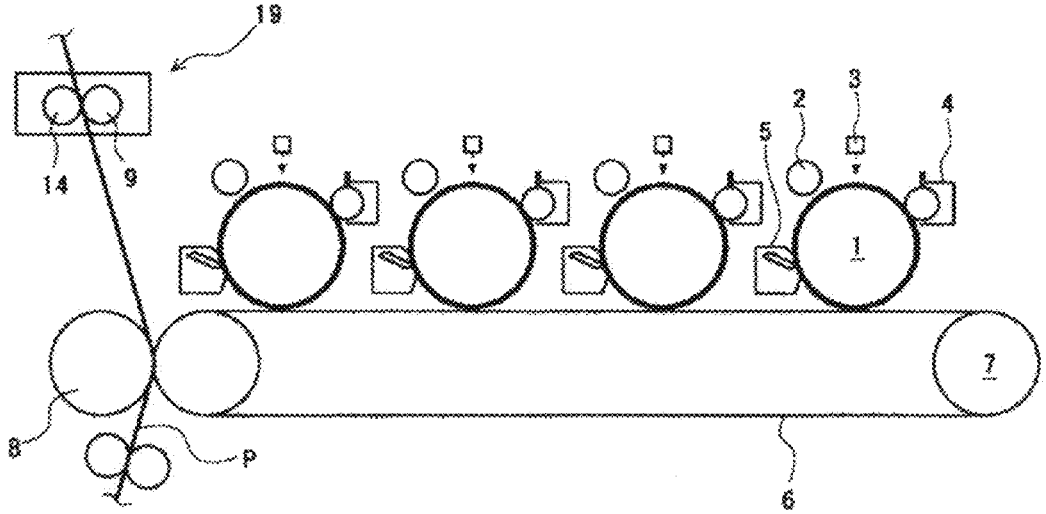
FIG. 4 is an explanatory view of another image forming apparatus in which an electrostatic image developing toner is used.

FIG. 4 is a schematic view of an example of a multi-color image forming apparatus to which the present invention is applied. The multi-color image forming apparatus shown in FIG. 4 is a tandem-type full color image forming apparatus.

The image forming apparatus of FIG. 4 contains, in an unillustrated main body casing, latent image bearing members (1) rotated clockwise in FIG. 4 which are each provided therearound with a charging device (2), an exposing device (3), a developing device (4), an intermediate transfer medium (6), a supporting roller (7) and a transfer roller (8). This image forming apparatus has an unillustrated paper-feeding cassette containing a plurality of recording paper sheets. The recording paper sheets (P) in the paper-feeding cassette are fed one by one with an unillustrated paper-feeding roller to between the intermediate transfer medium (6) and the transfer roller (8), followed by fixing with a fixing unit (19). Before fed to therebetween, the recording paper sheet is retained with a pair of registration rollers so that it can be fed at a desired timing.

In this image forming apparatus, while being rotated clockwise in FIG. 4, each of the latent image bearing members (1) is uniformly charged with the corresponding charging device (2). Then, the latent image bearing member (1) is irradiated with laser beams modulated by image date from the corresponding exposing device (3), to thereby form a latent electrostatic image. The latent electrostatic image formed on the latent image bearing member (1) is developed with the toner using the corresponding developing device (4). Next, the toner image, which has formed by applying the toner to the latent image bearing member with the developing device (4), is transferred from the latent image bearing member (1) to the intermediate transfer medium. The above-described process is performed in four colors of cyan (C), magenta (M), yellow (Y) and black (K), to thereby form a full color toner image.

Figure 5:
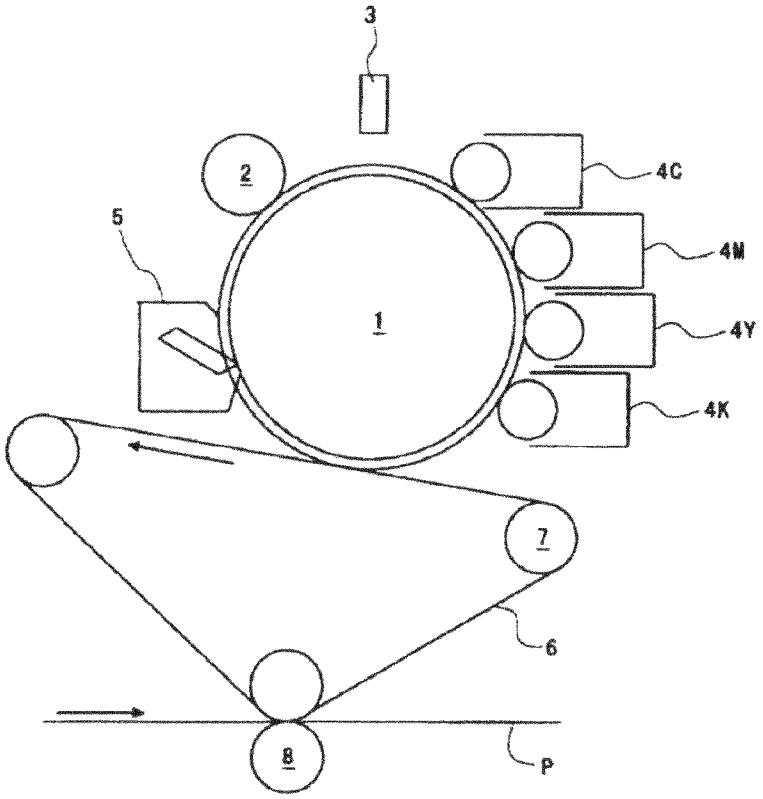
FIG. 5 is an explanatory view of still another image forming apparatus in which an electrostatic image developing toner is used.

FIG. 5 is a schematic view of an example of a full color image forming apparatus of revolver type. This image forming apparatus switches the operation of each developing device to sequentially apply color toners onto one latent image bearing member (1) for development. A transfer roller (8) is used to transfer the color toner image from the intermediate transfer medium (6) onto a recording paper sheet (P), which is then conveyed to a fixing part for obtaining a fixed image.

In the image forming apparatus after the toner image has been transferred from the intermediate transfer member (6) onto the recording paper sheet (P), the latent image bearing member (1) is further rotated to reach a cleaning part (5) where the toner remaining on the surface of the latent image bearing member (1) is scraped off by a blade, followed by charge-eliminating. Then, the image forming apparatus uniformly charges, with the charging device (2), the latent image bearing member (1) charge-eliminated by the charge-eliminating device, and performs the next image formation in the same manner as described above. Notably, the cleaning part (5) is limited to the part where the toner remaining on the latent image bearing member (1) is scraped off by a blade. For example, the cleaning part (5) may be a part where the toner remaining on the latent image bearing member (1) is scraped off by a fur brush.

The image forming method or image forming apparatus of the present invention uses as a developer the toner of the present invention, and thus can provide good images.

<Process Cartridge>

A process cartridge of the present invention includes at least a latent electrostatic image bearing member and a developing unit configured to develop a latent electrostatic image formed on of the latent electrostatic image bearing member with the toner of the present invention to form a visible image; and, if necessary, further includes appropriately selected other units such as a charging unit, a developing unit, a transfer unit, a cleaning unit and a charge-eliminating unit, wherein the process cartridge is detachably mounted to the main body of an image forming apparatus.

The developing unit has at least the toner of the present invention or a developer container housing the developer, and a developer bearing member which bears and conveys the toner or the developer housed in the developer container; and optionally includes, for example, a layer thickness-regulating member for regulating the layer thickness of the toner on the developer bearing member. The process cartridge of the present invention can be mounted detachably to various electrophotographic apparatuses, facsimiles and printers. Preferably, it is mounted detachably to the below-described image forming apparatus of the present embodiment.

Figure 6:
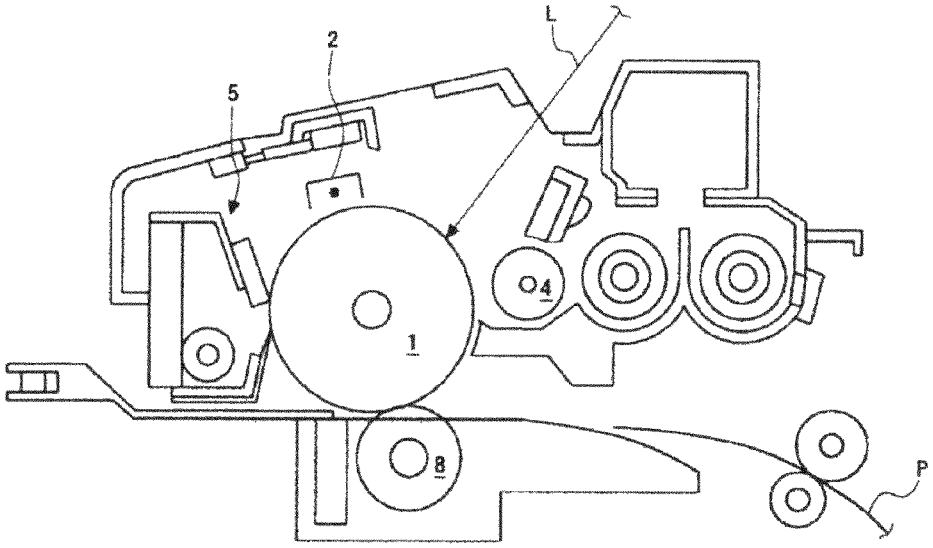
FIG. 6 is an explanatory view of a process cartridge in which an electrostatic image developing toner is used.

As shown in FIG. 6, the process cartridge includes a latent image bearing member (1), a charging device (2), a developing device (4), a transfer roller (8) and a cleaning part (5); and, if necessary, further includes other units. In FIG. 6, (L) denotes light emitted from an unillustrated exposing device and (P) denotes a recording paper sheet. The latent image bearing member (1) may be the same as that used in the above-described image forming apparatus. The charging device (2) may be any charging member.

Next, description will be given to image forming process by the process cartridge shown in FIG. 6. While being rotated clockwise, the latent image bearing member (1) is charged with the charging device (2) and then is exposed to light (L) emitted from the unillustrated exposing unit. As a result, a latent electrostatic image in response to an exposure pattern is formed on the surface of the latent image bearing member (1). The latent electrostatic image is developed with the toner in the developing device (4). The developed toner image is transferred with the transfer roller (8) onto the recording paper sheet (P), which is then printed out. Next, the latent image bearing member surface from which the toner image has been transferred is cleaned in the cleaning part (5), and is charge-eliminated with an unillustrated charge-eliminating unit. The above-described process is repeatedly performed.

EXAMPLES

The present invention will next be described in more detail by way of Examples and Comparative Examples. The present invention should not be construed as being limited to the Examples.

In Examples, the units "part(s)" and "%" mean "part(s) by mass" and "% by mass" respectively, unless otherwise specified.

First will be described methods of analyzing and evaluating toners produced in Examples and Comparative Examples.

The following evaluation was performed the toner of the present embodiment used as a one-component developer. However, the toner of the present embodiment can be used also as a two-component developer by using an appropriate external agent and an appropriate carrier.

<Measurement Method>

(Average Particle Diameter)

Next will be described a measurement method for particle size distribution of toner particles.

Examples of measurement apparatus employable in the measurement of the particle size distribution of toner particles by the Coulter counter method include a Coulter Counter TA-II and Coulter Multisizer II (these products are of Beckman Coulter, Inc.). The measurement method will next be described.

First, a surfactant (0.1 mL to 5 mL), preferably an alkylbenzene sulfonic acid salt, is added as a dispersing agent to an electrolyte solution (100 mL to 150 mL). Here, the electrolyte solution is an about 1% by mass aqueous NaCl solution prepared using 1st grade sodium chloride, and examples of commercially available products thereof include ISOTON-II (product of Beckman Coulter, Inc.). Subsequently, a measurement sample (2 mg to 20 mg based on the solid matter) is suspended in the above-obtained electrolyte solution. The resultant electrolyte solution is dispersed with an ultrasonic wave disperser for about 1 min to about 3 min. The thus-obtained dispersion liquid is analyzed with the above-described apparatus using an aperture of 100 μm to measure the number or volume of the toner particles. Then, the volume particle size distribution and number particle size distribution are calculated from the obtained values. From these distributions, the volume average particle diameter (Dv) and number average particle diameter (Dn) of the toner can be obtained.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

(Average Sphericity)

An optical detection method can properly be used for measuring particle shapes in which particle images are optically detected and analyzed by a CCD camera while a suspension containing particles passes through an imaging detective portion having a plate form. The average circularity of the particles is obtained by dividing the circumferential length of the circle having the same area as the projected area obtained in the above method, with the circumferential length of the actual particle.

The value was measured as the average sphericity using a flow-type particle image analyzer FPIA-2000 (product of SYSMEX CORPORATION). Specifically, 0.1 mL to 0.5 mL of a surfactant (preferably an alkylbenzene sulfonic acid salt) is added as a dispersing agent into 100 mL to 150 mL of water in a container, from which solid impurities have previously been removed. Then, about 0.1 g to about 0.5 g of a measurement sample is added to the container, followed by dispersing. The resultant suspension is subjected to dispersing treatment by an ultrasonic disperser for about 1 min to about 3 min, and the concentration of the dispersion liquid is adjusted such that the number of particles of the sample is 3,000 per microliter to 10,000 per microliter. In this state, the shape and distribution of the toner are measured using the analyzer.

(Volume Average Particle Diameter of Fine Resin Particles)

The volume average particle diameter of fine resin particles can be measured by a nano track particle size distribution analyzer (UPA-EX150, product of Nikkiso Co., Ltd.) based on a dynamic light scattering method or a laser Doppler method. Specifically, a dispersion liquid containing resin particles dispersed therein is adjusted to have a particle concentration falling within the measurable range. At the same time, only the dispersion medium (solvent) of the dispersion liquid is measured for background. The range of several tens nanometers to several micrometers, within which the volume average particle diameter of the resin particles used in the present invention falls, is measurable according to this measuring method.

(Molecular Weight)

The molecular weight of the resin used such as polyester resin or vinyl copolymer resin was measured through conventional GPC (gel permeation chromatography) under the following conditions.

Apparatus: HLC-8220GPC (product of Tosoh Corporation)
Column: TSKgel SuperHZM-M×3
Temperature: 40° C.
Solvent: THF (tetrahydrofuran)
Flow rate: 0.35 mL/min
Sample injected: 0.01 mL of a sample having a concentration of 0.05% to 0.6%

From the molecular weight distribution of the toner resin measured under the above conditions, the weight average molecular weight (Mw) of the resin were calculated using a molecular weight calibration curve obtained from monodispersed polystyrene standard samples. The monodispersed polystyrene standard samples used were the following ten samples having molecular weights of 5.8×100, 1.085×10,000, 5.95×10,000, 3.2×100,000, 2.56×1,000,000, 2.93×1,000, 2.85×10,000, 1.48×100,000, 8.417×100,000 and 7.5×1,000,000.

(Glass Transition Temperature and Endothermic Amount)

The glass transition temperature of the polyester resin and the vinyl copolymer resin used was measured with a differential scanning calorimeter (e.g., DSC-6220R, product of Seiko Instruments Inc.) in the following manner. First, a measurement sample was heated from room temperature to 150° C. at a temperature rising rate of 10° C./min. Then, the measurement sample was left to stand at 150° C. for 10 min and cooled to room temperature, followed by being left for 10 min. The measurement sample was heated again to 150° C. at a temperature rising rate of 10° C./min. In the obtained DSC curve, the glass transition temperature can be determined as the intersection formed between the base line equal to or lower than the glass transition temperature, and the tangential line of the curve representing glass transition.

However, when the glass transition temperature of the toner is measured by the above-described method, the measurement may be inaccurate due to overlapping with the melting heat curve of the releasing agent contained in the toner. In the present invention, the glass transition temperature of the toner and resin are measurements (TgA) obtained using the below-described flow tester.

In addition, the endothermic amount and the melting point of the releasing agent and the crystalline resin can be measured in the same manner as described above. The endothermic amount is obtained by calculating the peak area of the measured endothermic peak. In general, a releasing agent existing inside the toner (closer to the core of the toner particle) is melted at a temperature lower than the fixing temperature and at this time, the melting heat shows an endothermic peak. In addition, some releasing agents have generates heat upon phase transition at the solid phase, in addition to the melting heat. In the present invention, the total amount of both the heats is defined as the endothermic amount. Also, the melting point is defined as an endothermic peak temperature; i.e., a temperature at which the endothermic peak is observed.

(Measurement Method for TgA)

Figure 7A:
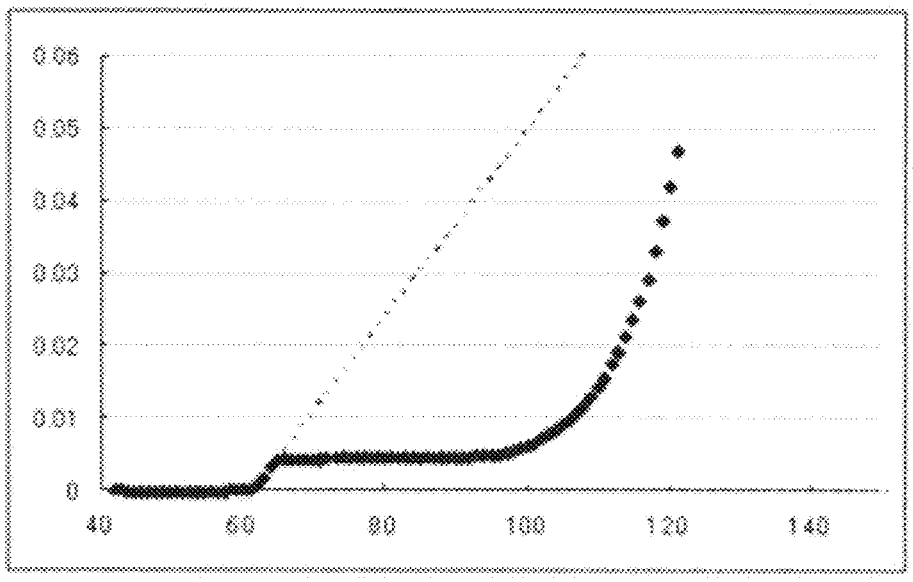
FIG. 7A is a graph for explaining the measurement of the glass transition temperature (TgA) of a toner or a resin.
Figure 7B:
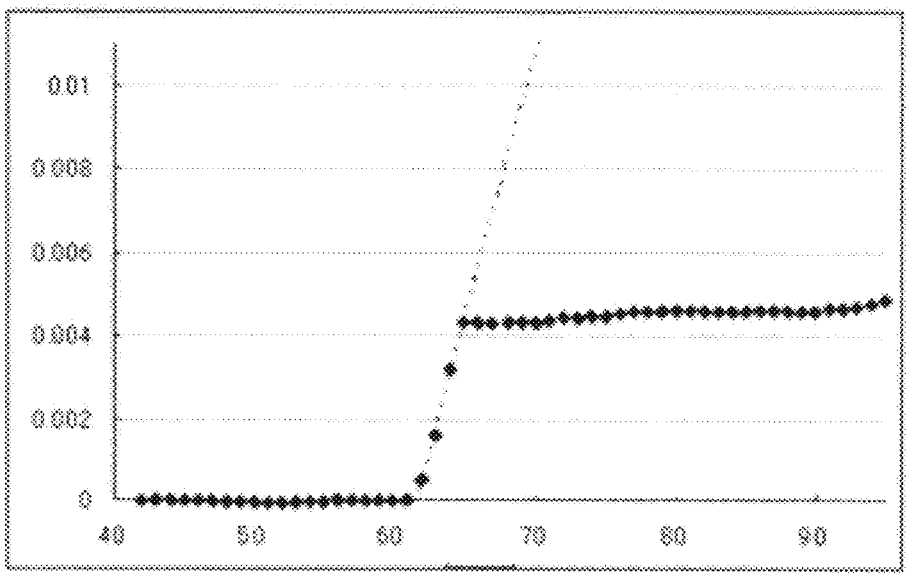
FIG. 7B is a partially enlarged graph of the graph of FIG. 7A.

A flow tester (CFT-500, product of Shimadzu Corporation) was used to measure TgA. Specifically, 1.0 g of a measurement sample was weighed and subjected to measurement using a die of 1.0 mm in height×0.5 mm in diameter under the following conditions: temperature rising rate: 3.0° C./min, pre-heating time: 180 sec, load: 30 kg, and measurement temperature range: 40° C. to 180° C. The TgA was defined as a temperature at which the measurement sample started deforming with rising of the temperature thereof (i.e., the sample was transferred into a rubber state). More specifically, the TgA was the intersection between the extended line of line B of smaller dots and the extended line of line A of larger dots shown in the graph of FIGS. 7A and 7B, where line B represents compression resulting from deformation of the sample in a rubber state and line A represents a non-deformed state (glass state) the sample receiving a compressive load maintains (in FIGS. 7A and 7B, line A is almost overlapped with X axis).

<Evaluation Method>

(Observation of Surface and Cross-Section of Toner)

The toner surface was observed under a SEM to evaluate how the fine particles were present.

State of the fine particles on the toner surface

A: The fine particles existed as particles to form convex portions; i.e., island portions of the sea-island structure, at 50% to 80% of the toner surface while maintaining proper gaps therebetween.

B: The fine particles were mainly attached to the core without being embedded therein, or the fine particles were not located uniformly in number (i.e., the existence density thereof was different from place to place).

C: The fine particles were attached to the core while not keeping their particle shape so that the sea-island structure was not formed, or the fine particles formed sea portions.

(Stress Resistance)

A predetermined printed pattern having a B/W (black/white) ratio of 6% was continuously printed with an externally-added toner in the N/N environment (23° C. and 45%) using IPSIO CX 2500 (product of Ricoh Company, Ltd.) After the printing of 2,000 sheets in the N/N environment (i.e., after running for evaluation of durability), the toner on the development roller under printing of a blank pattern was sucked to measure the amount of charge by an electrometer. The difference between the amount of charge after 50 sheet printing and that after 2,000 sheet printing was evaluated.

A: The difference between the amounts of charge was less than 5 μC/g as an absolute value.

B: The difference between the amounts of charge was 5 μC/g or more but less than 10 μC/g as an absolute value.

C: The difference between the amounts of charge was 10 μC/g or more but less than 15 μC/g as an absolute value.

D: The difference between the amounts of charge was 15 μC/g or more as an absolute value.

(Environmental Durability)

A predetermined printed pattern having a B/W ratio of 6% was continuously printed with an externally-added toner in the N/N environment (23° C. and 45%) using IPSIO CX 2500 (product of Ricoh Company, Ltd.). After the printing of 50 sheets, the toner on the development roller in printing blank sheet was sucked and the amount of charge was measured by an electrometer. Then, after the printing of 2,000 sheets in the N/N environment (i.e., after running for evaluation of durability), the N/N environment was changed to the H/H environment (27° C. and 80%) followed by measurement for the amount of charge by the electrometer in the same manner as described above. The difference between the amounts of charge measured in the H/H environment after the 50-sheet printing and after the 2,000-sheet printing in the N/N environment was evaluated.

A: The difference of the amounts of charge was less than 10 μC/g as an absolute value.

B: The difference of the amounts of charge was 10 μC/g or more but less than 15 μC/g as an absolute value.

C: The difference of the amounts of charge was 15 μC/g or more as an absolute value.

(Fixing Property)

Using IPSIO CX 2500 (product of Ricoh Company, Ltd.), an unfixed solid image having a width of 36 mm was printed with the externally-added toner (developer) in the region of 3 mm from the front end of an A4 sheet fed so that its shorter side entered the apparatus (deposition amount of 11 g/m$^2$). This unfixed image was fixed by using the following fixing device in the temperature range of 115° C. to 175° C. in increments of 10° C. to obtain a separable and non-offset temperature range. The separable and non-offset temperature range refers to a fixing temperature range within which the paper sheet was suitably separated from the heating roller without causing an offset phenomenon. Regarding the paper sheet and the paper-feeding direction, 45 g/m$^2$ paper whose grains are in parallel with the shorter side of the paper was used and fed so that the shorter side thereof entered the fixing device, which was disadvantageous in terms of separation of paper. The circumferential speed of the fixing device was set to be 200 mm/sec.

The fixing device used was of a soft roller type having a fluorine-containing surface layer as shown in FIG. 3. Specifically, a heating roller 9 has an outer diameter of 40 mm and has an aluminum core 10 and a silicone rubber elastic layer 11 having a thickness of 1.5 mm and a PFA (copolymer of tetrafluoroethylene-perfluoroalkyl vinyl ether) surface layer 12 which are provided on the aluminum core 10. And, a heater 13 is provided inside the aluminum core. The fixing device also includes a pressure roller 14 has an outer diameter of 40 mm and has an aluminum core 15, a silicone rubber elastic layer 16 having a thickness of 1.5 mm and a PFA surface layer 17 which are provided on the on the aluminum core 15. Paper P on which an unfixed image 18 has been printed passes through the fixing device as shown in FIG. 3.

A: The paper sheet was separable and non-offset in the entire range of 110° C. to 170° C. and the fixed image was sufficiently durable.

B: The paper sheet was separable and non-offset in the entire range of 110° C. to 170° C. but the fixed image was easily peeled off or damaged as a result of scraping or rubbing at low temperatures.

C: The separable and non-offset temperature range was 30° C. or higher but lower than 60° C. in the range of 110° C. to 170° C.

D: The separable and non-offset temperature range was lower than 30° C. in the range of 110° C. to 170° C.

(High-Temperature Storage Stability)

The toner was stored at 55° C. for 8 hours and thereafter screened with a sieve having a 42 mesh for 2 minutes and the residual rate of the toner remaining on the wire screen was determined as an index of the high-temperature storage stability. The toner was evaluated and ranked into 4 levels with regard to the high-temperature storage stability.

A: The residual rate was lower than 10%.

B: The residual rate was 10% or higher but lower than 20%.

C: The residual rate was 20% or higher but lower than 30%.

D: The residual rate was 30% or higher.

Next will be described preparation method for toner materials used in Examples.

<Second Resin: Synthesis of Non-Crystalline Polyester>

(Polyester 1)

A reaction container equipped with a condenser, a stirrer and a nitrogen-introducing pipe was charged with bisphenol A ethylene oxide 2 mol adduct (2,765 parts), bisphenol A propylene oxide 2 mol adduct (480 parts), terephthalic acid (1,100 parts), adipic acid (225 parts) and dibutyl tinoxide (10 parts), followed by reaction at 230° C. for 8 hours under normal pressure. Next, the reaction mixture was allowed to react for 5 hours at a reduced pressure of 10 mmHg to 15 mmHg. Then, trimellitic anhydride (130 parts) was added to the reaction container, followed by reaction at 180° C. for 2 hours under normal pressure, to thereby synthesize [polyester 1]. The thus-obtained [polyester 1] was found to have a number average molecular weight of 2,600, a weight average molecular weight of 8,000, a glass transition temperature of 68° C. and an acid value of 20.

(Polyester 2)

A reaction container equipped with a condenser, a stirrer and a nitrogen-introducing pipe was charged with bisphenol A ethylene oxide 2 mol adduct (1,195 parts), bisphenol A propylene oxide 3 mol adduct (2,765 parts), terephthalic acid (900 parts), adipic acid (200 parts) and dibutyl tinoxide (10 parts), followed by reaction at 230° C. for 8 hours under normal pressure. Next, the reaction mixture was allowed to react for 5 hours at a reduced pressure of 10 mmHg to 15 mmHg. Then, trimellitic anhydride (220 parts) was added to the reaction container, followed by reaction at 180° C. for 2 hours under normal pressure, to thereby synthesize [polyester 2]. The thus-obtained [polyester 2] was found to have a number average molecular weight of 2,000, a weight average molecular weight of 9,000, a glass transition temperature of 73° C. and an acid value of 19.

(Polyester 3)

A reaction container equipped with a condenser, a stirrer and a nitrogen-introducing pipe was charged with bisphenol A ethylene oxide 2 mol adduct (264 parts), bisphenol A propylene oxide 2 mol adduct (523 parts), terephthalic acid (123 parts), adipic acid (173 parts) and dibutyl tinoxide (1 part), followed by reaction at 230° C. for 8 hours under normal pressure. Next, the reaction mixture was allowed to react for 8 hours at a reduced pressure of 10 mmHg to 15 mmHg. Then, trimellitic anhydride (26 parts) was added to the reaction container, followed by reaction at 180° C. for 2 hours under normal pressure, to thereby synthesize [polyester 3]. The thus-obtained [polyester 3] was found to have a number average molecular weight of 4,000, a weight average molecular weight of 47,000, a glass transition temperature of 65° C. and an acid value of 12.

<First Resin: Synthesis of Crystalline Polyester>

(Polyester 4)

A reaction container equipped with a condenser, a stirrer and a nitrogen-introducing pipe was charged with 1,6-hexanediol (500 parts), succinic acid (500 parts) and dibutyl tinoxide (2.5 parts), followed by reaction at 200° C. for 8 hours under normal pressure. The reaction mixture was further allowed to react for 1 hour at a reduced pressure of 10 mmHg to 15 mmHg, to thereby obtain [polyester 4]. The [polyester 4] was found to have an endothermic peak of 66° C. as measured by DSC.

(Polyester 5)

A reaction container equipped with a condenser, a stirrer and a nitrogen-introducing pipe was charged with bisphenol A ethylene oxide 2 mol adduct (2,765 parts), bisphenol A propylene oxide 2 mol adduct (480 parts), terephthalic acid (1,100 parts), adipic acid (225 parts) and dibutyl tinoxide (10 parts), followed by reaction at 230° C. for 8 hours under normal pressure. Next, the reaction mixture was allowed to react for 5 hours at a reduced pressure of 10 mmHg to 15 mmHg. Then, trimellitic anhydride (130 parts) was added to the reaction container, followed by reaction at 180° C. for 2 hours under normal pressure, to thereby synthesize [polyester 5]. The thus-obtained [polyester 5] was found to have a number average molecular weight of 2,200, a weight average molecular weight of 5,600, a glass transition temperature (Tg) of 43° C. and an acid value of 24.

<Synthesis of Prepolymer>

A reaction container equipped with a condenser, a stirrer and a nitrogen-introducing pipe was charged with 1,2-puropylene glycol (366 parts), terephthalic acid (566 parts), trimillitic anhydride (44 parts) and titanium tetrabutoxide (6 parts), followed by reaction at 230° C. for 8 hours under normal pressure. Additionally, the reaction mixture was allowed to react for 5 hours at a reduced pressure of 10 mmHg to 15 mmHg, to thereby obtain [intermediate polyester 1]. The thus-obtained [intermediate polyester 1] was found to have a number average molecular weight of 3,200, a weight average molecular weight of 12,000, and a glass transition temperature of 55° C.

Next, a reaction container equipped with a condenser, a stirrer and a nitrogen-introducing pipe was charged with [intermediate polyester 1] (420 parts), isophorone diisocyanate (80 parts) and ethyl acetate (500 parts), followed by reaction at 100° C. for 5 hours, to thereby obtain [prepolymer]. The obtained [prepolymer] was found to have a free isocyanate of 1.34% by mass.

<Third Resin: Production of Fine Resin Particles>

(Fine Resin Particles V-1)

A reaction container equipped with a condenser, a stirrer and a nitrogen-introducing pipe was charged with sodium lauryl sulfate (1.6 parts) and ion-exchange water (492 parts), followed by heating to 80° C. Then, a solution of potassium persulfate (2.5 parts) in ion-exchange water (100 parts) was added to the resultant solution. Fifteen minutes after the addition, a mixture of a styrene monomer (170 parts), butylacrylate (30 parts), and n-octyl mercaptan (1.2 parts) was added dropwise to the resultant mixture for 90 min. Subsequently, the temperature of the mixture was maintained at 80° C. for 60 min. Then, the reaction mixture was cooled to obtain a dispersion liquid of [fine resin particles V-1]; i.e., fine particles of vinyl copolymer resin. The solid content concentration of the obtained dispersion liquid was measured and found to be 25%. Also, the volume average particle diameter of the fine particles was found to be 110 nm. Subsequently, a small portion of the thus-obtained dispersion liquid was added to a Petri dish, where the dispersion medium was evaporated. The obtained solid product was measured for number average molecular weight, weight average molecular weight and Tg, which were found to be 21,000, 43,000 and 70° C., respectively.

(Fine Resin Particles V-2 to V-4)

[Fine resin particles V-2], [fine resin particles V-3] and [fine resin particles V-4] were produced in the same manner as in the production of the [fine resin particles V-1] except that the monomer composition was changed as shown in Table 1. The properties of the [fine resin particles V-2 to V-4] are shown in Table 1.

<Preparation of Masterbatch>

Carbon black (REGAL 400R, product of Cabot Corporation) (40 parts), a binder resin (polyester resin) (60 parts) (RS-801, product of Sanyo Chemical Industries, Ltd., acid value: 10, Mw: 20,000, Tg: 64° C.) and water (30 parts) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm in diameter, whereby [masterbatch 1] was obtained.

Example 1

Preparation of Oil Phase

A container to which a stirring rod and a thermometer had been set was charged with [polyester 1] (4 parts), [polyester 4] (20 parts), [paraffin wax (melting point: 72° C.)] (8 parts) and ethyl acetate (96 parts). The mixture was increased in temperature to 80° C. under stirring, maintained at 80° C. for 5 hours, and cooled to 30° C. for 1 hour. Then, the container was charged with [masterbatch 1] (35 parts), followed by mixing for 1 hour. The obtained mixture was placed in another container, where the mixture was dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes, to thereby obtain [raw material solution 1]. Next, 74.1 parts of a 70% ethyl acetate solution of the [polyester 1], 21.6 parts of the [polyester 3] and 21.5 parts of ethyl acetate were added to 81.3 parts of the [raw material solution 1], followed by stirring with a three-one motor for 2 hours, to thereby obtain [oil phase 1]. Furthermore, ethyl acetate was added to the [oil phase 1] so that the solid content concentration thereof was adjusted to 49% as measured at 130° C. for 30 min.

Preparation of Aqueous Phase

Ion-exchange water (472 parts), a 50% aqueous solution of sodium dodecyldiphenyl ether disulfonate (ELEMINOL MON-7, product of Sanyo Chemical Industries Ltd.) (81 parts), a 1% aqueous solution of carboxymethyl cellulose serving as a thickening agent (67 parts) and ethyl acetate (54 parts) were mixed together and stirred to obtain an opaque white liquid, which was used as [aqueous phase 1].

Emulsification Step

The [aqueous phase 1] (321 parts) was added to the total amount of the above-obtained [oil phase 1]. The resultant mixture was stirred with the TK homomixer at 8,000 rpm to 13,000 rpm for 20 min, to thereby obtain [core particles slurry 1].

Shell Formation Step

Attachment Step of Fine Resin Particles onto Core Particles

While the [core particles slurry 1] was being stirred with a three-one motor at 200 rpm, the [fine resin particles V-1 of vinyl copolymer] (21.4 parts) was added dropwise thereto for 5 min and then stirred for 30 min. Thereafter, a small amount of the slurry was sampled and diluted with water having an amount of 10 times the amount of the slurry, followed by centrifugating with a centrifugal apparatus, so that toner base particles sedimented on the bottom of the test tube and the supernatant was almost transparent. In this manner, [post-shell formation slurry 1] (i.e., a slurry obtained after the shell formation step) was obtained.

Desolvation

A container to which a stirrer and a thermometer had been set was charged with the [post-shell formation slurry 1] and then desolvated at 30° C. for 8 hours to obtain [dispersion slurry 1].

Washing/Drying

After [dispersion slurry 1] (100 parts) had been filtrated under reduced pressure, the following treatments (1) to (4) were performed.

(1) Ion-exchange water (100 parts) was added to the filtration cake, followed by mixing with a TK homomixer (at 12,000 rpm for 10 min) and filtrating.

(2) Ion-exchange water (100 parts) was added to the filtration cake obtained in (1). The resultant mixture was mixed with a TK homomixer (at 12,000 rpm for 30 min) under application of ultrasonic vibration, followed by filtrating under reduced pressure. This treatment was repeated until the reslurry had an electrical conductivity of 10 μS/cm or lower.

(3) 10% hydrochloric acid was added to the reslurry obtained in (2) so as to have a pH of 4, followed by stirring for 30 min with a three-one motor and filtrating.

(4) Ion-exchange water (100 parts) was added to the filtration cake obtained in (3), followed by mixing with a TK homomixer (at 12,000 rpm for 10 min) and filtrating. This treatment was repeated until the reslurry had an electrical conductivity of 10 μS/cm or lower, to thereby obtain [filtration cake 1]. The untreated [dispersion slurry 1] was similarly washed, and the obtained filtration cake was mixed with the [filtration cake 1].

The [filtration cake 1] was dried with an air-circulation dryer at 45° C. for 48 hours, and then sieved with a mesh having an opening size of 75 μm to obtain [toner base 1]. The obtained [toner base 1] (50 parts) was mixed using HENSCHEL MIXER with 1 part of hydrophobic silica having a primary particle diameter of about 30 nm and 0.5 parts of hydrophobic silica having a primary particle diameter of about 10 nm, to thereby obtain [developer 1] according to the present embodiment.

FIG. 1 is a SEM image of the obtained toner base 1. The toner surface has a sea-island structure where the island portions are protruded from the sea portion to form convex portions. The island portions are fine resin particles formed of the third resin.

Example 2

[Developer 2] was obtained in the same manner as in Example 1 except that the [fine resin particles V-1 of vinyl copolymer] was changed in the shell formation step to the [fine resin particles V-2 of vinyl copolymer].

Example 3

[Developer 3] was obtained in the same manner as in Example 1 except that the [polyester 1] was changed to the [polyester 2].

Example 4

A container to which a stirring rod and a thermometer had been set was charged with the [polyester 1] (4 parts), the [polyester 4] (20 parts), paraffin wax (melting point: 72° C.) (8 parts) and ethyl acetate (96 parts). The mixture was increased in temperature to 80° C. under stirring, maintained at 80° C. for 5 hours, and cooled to 30° C. for 1 hour. Then, the container was charged with the [masterbatch 1] (35 parts), followed by mixing for 1 hour. The obtained mixture was placed in another container, where the mixture was dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes, to thereby obtain [raw material solution 1]. Next, 84.4 parts of a 70% ethyl acetate solution of the [polyester 1] was added to 81.3 parts of the [raw material solution 1], followed by stirring with a three-one motor for 2 hours, to thereby obtain [oil phase 4]. Furthermore, ethyl acetate was added to the [oil phase 4] so that the solid content concentration thereof was adjusted to 50% as measured at 130° C. for 30 min.

Emulsification Step

The total amount of the above-obtained [oil phase 4] was mixed with 0.4 parts of isophoronediamine and 28.5 parts of the [prepolymer] using a TK homomixer (product of PRIMIX Corporation) at 5,000 rpm for 1 min. Thereafter, the total amount of the [aqueous phase 1] was added thereto, and the resultant mixture was mixed with the TK homomixer at 8,000 rpm to 13,000 rpm for 20 min, to thereby obtain [core particles slurry 4].

Shell Formation Step

While the [core particles slurry 4] was being stirred with a three-one motor at 200 rpm, the [fine resin particles V-1 of vinyl copolymer] (21.4 parts) was added dropwise thereto for 5 min and then stirred for 30 min. Thereafter, a small amount of the slurry was sampled and diluted with water having an amount of 10 times the amount of the slurry, followed by centrifugating with a centrifugal apparatus, so that toner base particles sedimented on the bottom of the test tube and the supernatant was almost transparent. In this manner, [post-shell formation slurry 4] (i.e., a slurry obtained after the shell formation step) was obtained.

The subsequent steps were performed in the same manner as in Example 1 to obtain [developer 4].

Comparative Example 1

[Developer 5] was obtained in the same manner as in Example 1 except that the [polyester 1] was changed to the [polyester 3].

Comparative Example 2

[Developer 6] was obtained in the same manner as in Example 1 except that the [fine resin particles V-1 of vinyl copolymer] was changed in the shell formation step to the [fine resin particles V-3 of vinyl copolymer].

Comparative Example 3

[Developer 5] was obtained in the same manner as in Example 1 except that the [polyester 4] was changed to the [polyester 1].

Comparative Example 4

[Developer 6] was obtained in the same manner as in Example 4 except that the [fine resin particles V-1 of vinyl copolymer] was changed in the shell formation step to the [fine resin particles V-4 of vinyl copolymer].

Table 1 shows the fine resin particle of vinyl copolymers.

TABLE 1

| Fine Resin particles | Composition St | Composition BA | Properties Tg | Properties Particle diameter | Properties Mw |
|---|---|---|---|---|---|
| V-1 | 85 | 15 | 70 | 110 | 42,000 |
| V-2 | 93 | 7 | 74 | 110 | 40,000 |
| V-3 | 100 | 0 | 83 | 100 | 38,000 |
| V-4 | 70 | 30 | 58 | 100 | 43,000 |

Tables 2 and 3 show the properties and evaluation results of the developers obtained in Examples and Comparative Examples.

TABLE 2

| | Developer | First resin | Second resin | Third resin | Tc1 | Tg2 | Tg3 | Tgt |
|---|---|---|---|---|---|---|---|---|
| Ex. 1 | 1 | Polyester 4 | Polyester 1 | Fine resin particles V-1 | 66 | 68 | 70 | 61 |
| Ex. 2 | 2 | Polyester 4 | Polyester 1 | Fine resin particles V-2 | 66 | 68 | 74 | 62 |
| Ex. 3 | 3 | Polyester 4 | Polyester 2 | Fine resin particles V-1 | 66 | 73 | 70 | 64 |
| Ex. 4 | 4 | Polyester 4 | Polyester 1 | Fine resin particles V-1 | 66 | 68 | 70 | 62 |
| Comp. Ex. 1 | 5 | Polyester 4 | Polyester 5 | Fine resin particles V-1 | 66 | 43 | 70 | 50 |
| Comp. Ex. 2 | 6 | Polyester 4 | Polyester 1 | Fine resin particles V-3 | 66 | 68 | 83 | 63 |
| Comp. Ex. 3 | 7 | Not used | Polyester 1 | Fine resin particles V-1 | — | 68 | 70 | 67 |
| Comp. Ex. 4 | 8 | Polyester 4 | Polyester 1 | Fine resin particles V-4 | 66 | 68 | 58 | 59 |

Tg3: Tg of the fine resin particles

TABLE 3

| | Developer | Toner particle diameter Dv | Dn | Dv/Dn | Shape Sphericity | Surface Surface | Evaluation Results Stress Resistance | Environmental Durability | Fixing Property | High-Temperature Storage Stability |
|---|---|---|---|---|---|---|---|---|---|---|
| Ex. 1 | 1 | 6.2 | 5.5 | 1.13 | 0.980 | B | A | B | B | B |
| Ex. 2 | 2 | 6.2 | 5.4 | 1.15 | 0.979 | B | B | B | B | A |
| Ex. 3 | 3 | 6.3 | 5.5 | 1.15 | 0.980 | B | A | B | B | A |
| Ex. 4 | 4 | 6.1 | 5.4 | 1.13 | 0.981 | B | B | B | A | B |
| Comp. Ex. 1 | 5 | 6.2 | 5.5 | 1.13 | 0.979 | B | C | C | B | D |
| Comp. Ex. 2 | 6 | 6.1 | 5.4 | 1.13 | 0.980 | B | A | B | C | A |
| Comp. Ex. 3 | 7 | 6.3 | 5.5 | 1.15 | 0.982 | B | B | B | D | A |
| Comp. Ex. 4 | 8 | 6.2 | 5.5 | 1.13 | 0.982 | B | D | C | B | C |

In the present embodiment, the developers of Examples showed good results. However, all the developers of Comparative Examples did not show good results, since they were not excellent in all the evaluation results such as fixing property and stress resistance.

This application claims priority to Japanese application No. 2011-163019, filed on Jul. 26, 2011 and incorporated herein by reference.

What is claimed is:

1. A toner comprising:

a core particle; and fine resin particles, the core particle containing at least a binder resin, a releasing agent and a colorant, wherein the toner is in shape of particles, and each toner particle has a sea-island structure having the core particle and island portions, which are convex portions formed from the fine resin particles on a surface of the core particle, wherein the binder resin contains at least a first resin and a second resin, and the fine resin particles are each made of a third resin, wherein the first resin is a crystalline resin, and the second resin and the third resin are each a non-crystalline resin, wherein the second resin has a glass transition temperature (Tg2) and the crystalline resin has a melting point (Tc1) where the glass transition temperature (Tg2) is higher than the melting point (Tc1), and wherein the third resin has a glass transition temperature (Tg3) and the toner has a glass transition temperature (Tgt) where the glass transition temperature (Tg3) is higher than the glass transition temperature (Tgt).

2. The toner according to claim 1, wherein the melting point (Tc1) is higher than the glass transition temperature (Tgt).

3. The toner according to claim 1, wherein a difference ΔT between the maximum value and the minimum value among the Tg2, the Tg3, the Tgt and the Tc1 is greater than 0° C. but smaller than 10° C.

4. The toner according to claim 1, wherein the core particle is made mainly of the second resin where at least the first resin, the releasing agent and the colorant are dispersed.

5. The toner according to claim 1, wherein the first resin, the second resin and the third resin are incompatible one another.

6. The toner according to claim 1, wherein the first resin is a crystalline polyester resin, the second resin is a non-crystalline polyester resin, and the third resin is a vinyl resin.

7. The toner according to claim 1, wherein the third resin is a vinyl resin obtained by polymerizing a monomer mixture containing 80% by mass to 99% by mass of an aromatic compound monomer having a vinyl polymerizable functional group and 1% by mass to 20% by mass of an acryl monomer.

8. The toner according to claim 7, wherein the monomer mixture contains 80% by mass to 99% by mass of styrene and 1% by mass to 20% by mass of butyl acrylate, and a total amount of the styrene and the butyl acrylate contained in the monomer mixture is 90% by mass to 100% by mass.

9. The toner according to claim 1, wherein the binder resin further contains a modified polyester resin having at least one of a urethane group and a urea group.

10. The toner according to claim 9, wherein the modified polyester resin is chain-elongated, or crosslinked, or both chain-elongated and crosslinked by reacting an amine with a polyester resin having an isocyanate group at an end thereof.

11. The toner according to claim 1, wherein the fine resin particles have a weight average particle diameter of 50 nm to 300 nm, and a total surface area of the island portions is 50% to 80% of a total surface area of each toner particle.

12. The toner according to claim 1, wherein the convex portions have an average height of 0.03 μm to 0.1 μm.

13. The toner according to claim 1, wherein the releasing agent is at least one selected from the group consisting of paraffin wax, Fischer-Tropsch wax and polyethylene wax.

14. A developer comprising:

a toner which comprises:

a core particle; and fine resin particles, the core particle containing at least a binder resin, a releasing agent and a colorant, wherein the toner is in shape of particles, and each toner particle has a sea-island structure having the core particle and island portions, which are convex portions formed from the fine resin particles on a surface of the core particle, wherein the binder resin contains at least a first resin and a second resin, and the fine resin particles are each made of a third resin, wherein the first resin is a crystalline resin, and the second resin and the third resin are each a non-crystalline resin, wherein the second resin has a glass transition temperature (Tg2) and the crystalline resin has a melting point (Tc1) where the glass transition temperature (Tg2) is higher than the melting point (Tc1), and wherein the third resin has a glass transition temperature (Tg3) and the toner has a glass transition temperature (Tgt) where the glass transition temperature (Tg3) is higher than the glass transition temperature (Tgt).

15. A method for producing a toner, the method comprising:

dissolving or dispersing in an organic solvent at least a first resin, a second resin, a releasing agent and a colorant, to thereby prepare a solution or dispersion liquid, where the first resin is a crystalline resin and the second resin is a non-crystalline resin;

suspending the solution or dispersion liquid in an aqueous medium, to thereby prepare a dispersion liquid containing core particles dispersed therein, where each core particle contains at least the first resin, the second resin, the releasing agent and the colorant;

adding a fine resin particle dispersion liquid, which contains fine resin particles formed of a third resin dispersed therein, to the dispersion liquid containing the core particles dispersed therein, to thereby form convex portions formed of the fine resin particles on a surface of each of the core particles, where the third resin is a non-crystalline resin; and removing the organic solvent, wherein the second resin has a glass transition temperature (Tg2) and the crystalline resin has a melting point (Tc1) where the glass transition temperature (Tg2) is higher than the melting point (Tc1), and the third resin has a glass transition temperature (Tg3) and the toner has a glass transition temperature (Tgt) where the glass transition temperature (Tg3) is higher than the glass transition temperature (Tgt).

16. The method according to claim 15, wherein the aqueous medium comprises a surfactant.

17. The method according to claim 15, wherein the fine resin particle dispersion liquid contains no organic solvent and contains the fine resin particles in the form of solids dispersed therein.

18. The method according to claim 15, wherein the removing the organic solvent is completely removing the organic solvent after the convex portions have been formed.

19. The method according to claim 15, wherein in the adding the fine resin particle dispersion liquid, an amount of the organic solvent contained in the dispersion liquid containing the core particles dispersed therein is 10% by mass to 70% by mass relative to an amount of solid matter contained in the dispersion liquid containing the core particles dispersed therein.

* * * * *

UNITED STATES PATENT AND TRADEMARK OFFICE

CERTIFICATE OF CORRECTION

PATENT NO. : 8,642,238 B2
APPLICATION NO. : 13/557568
DATED : February 4, 2014
INVENTOR(S) : Tsuyoshi Nozaki et al.

It is certified that error appears in the above-identified patent and that said Letters Patent is hereby corrected as shown below:

On the title page, Item (30), the Foreign Application Priority Data Information has been omitted. Item (30) should read:

--(30) Foreign Application Priority Data

Jul. 26, 2011 (JP)……..2011-163019--

Signed and Sealed this
Twenty-ninth Day of April, 2014

Michelle K. Lee

Michelle K. Lee
*Deputy Director of the United States Patent and Trademark Office*